US007984581B2

(12) United States Patent
Rapp et al.

(10) Patent No.: US 7,984,581 B2
(45) Date of Patent: Jul. 26, 2011

(54) PROJECTILE ACCELERATOR AND RELATED VEHICLE AND METHOD

(75) Inventors: John W. Rapp, Manassas, VA (US); Robert J. Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 573 days.

(21) Appl. No.: 12/008,487

(22) Filed: Jan. 11, 2008

(65) Prior Publication Data

US 2010/0282057 A1 Nov. 11, 2010

Related U.S. Application Data

(63) Continuation-in-part of application No. 11/264,299, filed on Oct. 31, 2005, now Pat. No. 7,814,696.

(51) Int. Cl.
*F41A 19/58* (2006.01)
*F41A 1/08* (2006.01)
*F41C 9/06* (2006.01)

(52) U.S. Cl. ..... 42/84; 42/1.14; 89/1.7

(58) Field of Classification Search ..... 42/84, 1.14; 89/1.7, 1.701; 102/437
See application file for complete search history.

(56) References Cited

U.S. PATENT DOCUMENTS 1,108,715 A * 8/1914 Davis ..... 89/1.701
1,108,717 A * 8/1914 Davis ..... 102/430
1,303,266 A * 5/1919 Dougan ..... 114/316
1,349,414 A * 8/1920 Dougan ..... 89/1.701
1,395,630 A 11/1921 Davis
2,156,605 A * 5/1939 Prettyman ..... 89/1.701
2,372,804 A 4/1945 Vertzinsky
2,466,714 A * 4/1949 Kroeger et al. ..... 89/1.703
2,679,192 A * 5/1954 Seeley et al. ..... 89/14.3
3,013,472 A * 12/1961 Kahn et al. ..... 89/1.7
3,149,531 A * 9/1964 Musgrave ..... 89/1.701
3,279,319 A 10/1966 Semonian et al.
3,324,767 A * 6/1967 Alban ..... 89/1.1
3,633,509 A 1/1972 Grandy et al.
3,648,611 A 3/1972 Noel
3,800,656 A 4/1974 Schnabele
3,815,469 A 6/1974 Schubert et al.
4,210,082 A 7/1980 Brothers
4,643,071 A * 2/1987 Baechler et al. ..... 89/1.701
5,361,373 A 11/1994 Gilson
5,883,329 A 3/1999 O'Dwyer
6,123,007 A 9/2000 O'Dwyer
6,138,395 A 10/2000 O'Dwyer
6,223,642 B1 5/2001 O'Dwyer
(Continued)

*Primary Examiner* — Bret Hayes
(74) *Attorney, Agent, or Firm* — Mark A. Wurm; Bryan A. Santarelli; Graybeal Jackson LLP

(57) ABSTRACT

An unguided projectile-accelerator system includes an enclosure, first and second charges, first and second projectiles, and a recoil-absorbing mechanism. The enclosure has an open first end and a closed second end, and the first and second charges are disposed within the enclosure. The first projectile is disposed within the enclosure between the first charge and the first end and is operable to exit the enclosure via the first end and to generate a first recoil in response to detonation of the first charge. The second projectile is disposed within the enclosure between the first charge and the second charge and is operable to exit the enclosure via the first end and to generate a second recoil in response to detonation of the second charge. The recoil-absorbing mechanism is disposed adjacent to the enclosure and is operable to absorb at least a respective portion of each of the first and second recoil.

15 Claims, 10 Drawing Sheets

U.S. PATENT DOCUMENTS

| | | | |
|---|---|---|---|
| 6,286,408 | B1 | 9/2001 | Sanford et al. |
| 6,301,819 | B1 | 10/2001 | O'Dwyer |
| 6,343,553 | B1 | 2/2002 | O'Dwyer |
| 6,431,076 | B1 | 8/2002 | O'Dwyer |
| 6,477,801 | B1 | 11/2002 | O'Dwyer |
| 6,510,643 | B2 | 1/2003 | O'Dwyer |
| 6,543,174 | B2 | 4/2003 | O'Dwyer |
| 6,557,449 | B1 | 5/2003 | O'Dwyer |
| 6,701,818 | B1 | 3/2004 | O'Dwyer |
| 6,715,398 | B2 | 4/2004 | O'Dwyer |
| 6,722,252 | B1 | 4/2004 | O'Dwyer |
| 6,782,826 | B1 | 8/2004 | O'Dwyer |
| 6,860,187 | B2 | 3/2005 | O'Dwyer |
| 6,889,935 | B2 | 5/2005 | O'Dwyer |
| 7,487,302 | B2 | 2/2009 | Gouldey et al. |
| 2002/0002787 | A1 | 1/2002 | O'Dwyer |
| 2002/0152918 | A1 | 10/2002 | O'Dwyer |
| 2002/0157526 | A1 | 10/2002 | O'Dwyer |
| 2003/0121404 | A1 | 7/2003 | O'Dwyer |
| 2003/0122032 | A1 | 7/2003 | O'Dwyer |
| 2004/0093783 | A1 | 5/2004 | O'Dwyer |
| 2004/0130927 | A1 | 7/2004 | Schulz et al. |
| 2004/0133763 | A1 | 7/2004 | Mathur et al. |
| 2004/0136241 | A1 | 7/2004 | Rapp et al. |
| 2004/0170070 | A1 | 9/2004 | Rapp et al. |
| 2004/0181621 | A1 | 9/2004 | Mathur et al. |
| 2004/0231219 | A1 | 11/2004 | O'Dwyer |
| 2004/0237762 | A1 | 12/2004 | O'Dwyer |
| 2005/0022657 | A1 | 2/2005 | O'Dwyer |
| 2005/0081708 | A1 | 4/2005 | O'Dwyer |
| 2005/0246934 | A1 | 11/2005 | O'Dwyer |
| 2006/0085781 | A1 | 4/2006 | Rapp et al. |
| 2006/0087450 | A1 | 4/2006 | Schulz et al. |
| 2006/0101250 | A1 | 5/2006 | Rapp et al. |
| 2006/0101253 | A1 | 5/2006 | Rapp et al. |
| 2006/0101307 | A1 | 5/2006 | Rapp et al. |
| 2006/0123282 | A1 | 6/2006 | Gouldey et al. |
| 2006/0149920 | A1 | 7/2006 | Rapp et al. |
| 2006/0230377 | A1 | 10/2006 | Rapp et al. |

* cited by examiner

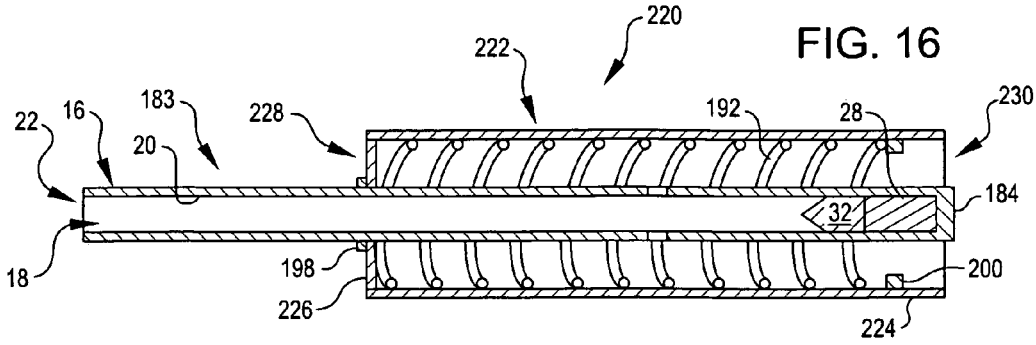
FIG. 16
FIG. 17
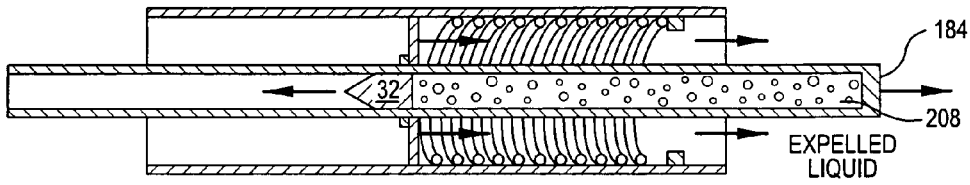
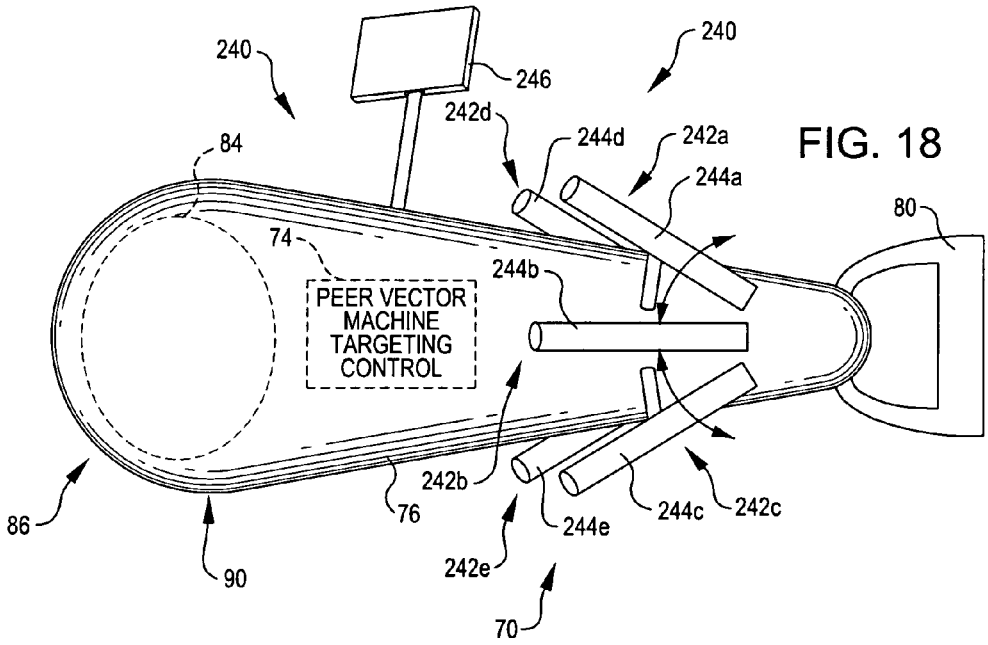
FIG. 18

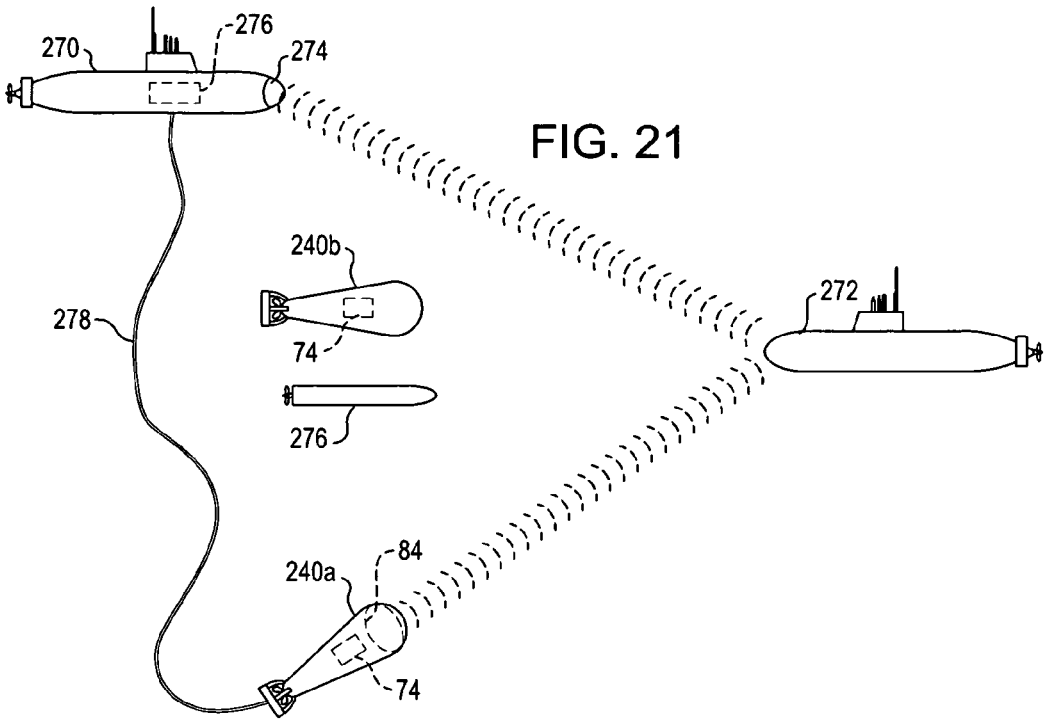
FIG. 21
FIG. 22
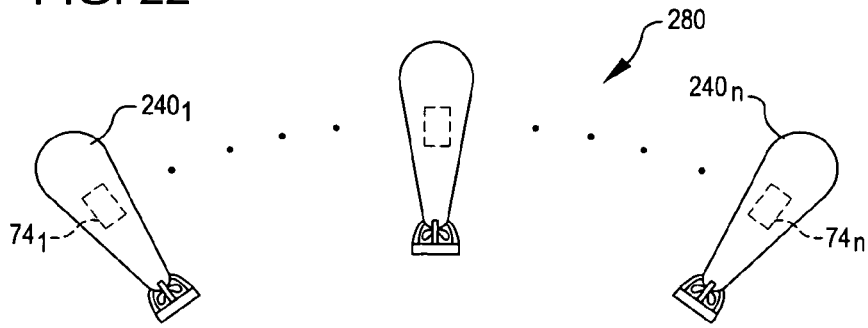

PROJECTILE ACCELERATOR AND RELATED VEHICLE AND METHOD

CLAIM OF PRIORITY

This application is a continuation-in-part of U.S. patent application Ser. No. 11/264,299 filed on Oct. 31, 2005, which claims priority to U.S. Provisional Application Ser. No. 60/623,312 filed on Oct. 29, 2004, which are incorporated by reference.

BACKGROUND

Systems exist for firing a projectile to disable or destroy a stationary or moving target; some of these systems fire a guided projectile, and others of these systems fire an unguided projectile.

An example of a guided-projectile system is a submarine torpedo system, which fires a guided intercept torpedo from a launch tube to disable or destroy a target such as an enemy submarine, an enemy ship, or an incoming torpedo. Before firing the intercept torpedo, an operator maneuvers the submarine such that the launch tube, and thus the intercept torpedo within the tube, are aimed at the target. But because the intercept torpedo is a guided projectile, a guidance subsystem, which is disposed on the intercept torpedo and/or on the submarine and which monitors the location of the target using, e.g., sonar, can steer the intercept torpedo toward the target even after the intercept torpedo leaves the launch tube. Therefore, the guidance subsystem can correct the intercept torpedo's trajectory if the launch tube was inaccurately aimed at the target when the intercept torpedo was fired from the tube, if the intercept torpedo's trajectory is altered by an unaccounted for force (e.g., a current), or if the target changes course.

Another example of a guided-projectile system is the ground-based Patriot® missile system, which aims an intercept missile at an incoming missile, fires the intercept missile, and, using phased-array radar, steers the fired intercept missile toward the incoming missile.

An example of an unguided-projectile system is a shipboard gun system, which fires an unguided shell to disable or destroy a target such as an enemy ship or aircraft. Before the gun fires the shell, an operator maneuvers the gun turret such that gun barrel, and thus the shell within the barrel, are aimed at the target. Because the shell is an unguided projectile, the gun cannot correct or otherwise affect the trajectory of the shell once the shell exits the barrel.

Guided- and unguided-projectile systems each have desirable features. For example, a guided projectile, such as a torpedo, is relatively small and can be unmanned, and an unguided projectile, such as a shell, is often relatively inexpensive to manufacture and maintain.

But unfortunately, guided- and unguided-projectile systems also have undesirable features.

Because a guided projectile, such as a torpedo, typically includes relatively complex subsystems, such as guidance, steering, power, and propulsion subsystems, a guided projectile is often relatively expensive to manufacturer and maintain. Furthermore, because a guided projectile is typically destroyed when it strikes a target, it is typically not reusable. Consequently, guided-projectile systems are often relatively expensive to maintain and operate because each time a guided projectile is launched, the projectile typically must be replaced.

Furthermore, an unguided-projectile system, such as a gun, often cannot be carried by an unmanned vehicle. For example, to accurately aim a ship-board gun barrel at a moving target, the gun's ranging subsystem computes the proper direction and azimuth of the gun barrel by executing a targeting algorithm that often accounts for the following factors: the temperature, wind velocity, and other weather conditions, the position, velocity, and acceleration of the ship on which the gun is located, the position, velocity, and acceleration of the target, and the strike location of one or more previously fired shells. Because the targeting algorithm is so complex, the ranging subsystem often includes a relatively large computer subsystem that consumes a significant amount of power and that requires significant peripheral services (e.g., cooling). Moreover, the shell loading/unloading subsystem is often unsuitable for an underwater unmanned vehicle, because the water may corrode or otherwise damage components of the loading/unloading subsystem. In addition, the "jerking" motion that the recoil of a ship-board gun may impart to an unmanned vehicle may have undesirable consequences. For example, the recoil may damage the vehicle, or turn the vehicle such that the ranging subsystem must re-aim the gun before firing the next round. Consequently, the relatively large sizes of the computer subsystem and power supply and gun-recoil affects may render an unguided-projectile system unsuitable for an unmanned vehicle. Furthermore, the lack of a suitable projectile loading/unloading subsystem may render an unguided-projectile system unsuitable for an unmanned underwater vehicle.

Moreover, there are few, if any, unguided projectiles that are suitable for firing underwater. Because water is denser than air, unguided projectiles, such as bullets and shells, designed for above-water targets often experience significant drag in water, and thus often have a limited underwater range of a few tens of meters.

SUMMARY

According to an embodiment of the invention, an unguided projectile-accelerator system includes an enclosure, first and second charges, first and second projectiles, and a recoil-absorbing mechanism. The enclosure has an open first end and a closed second end, and the first and second charges are disposed within the enclosure. The first projectile is disposed within the enclosure between the first charge and the first end and is operable to exit the enclosure via the first end and to generate a first recoil in response to detonation of the first charge. The second projectile is disposed within the enclosure between the first charge and the second charge and is operable to exit the enclosure via the first end and to generate a second recoil in response to detonation of the second charge. The recoil-absorbing mechanism is disposed adjacent to the enclosure and is operable to absorb at least a respective portion of each of the first and second recoil.

As compared to prior unguided-projectile systems, such an unguided-projectile system is often more suitable for an unmanned vehicle and for underwater use.

According to a related embodiment of the invention, a vehicle includes an apparatus, such as the above-described unguided projectile-accelerator system, operable to fire a projectile and a computing machine having an intercoupled processor and hardwired pipeline. The computing machine is operable to aim the apparatus at a target and to cause the aimed apparatus to fire the projectile at the target.

Such a vehicle may be an unmanned vehicle because the computing machine is often significantly smaller than a processor-based range-finding computer.

BRIEF DESCRIPTION OF THE DRAWINGS

FIG. 16 is a cross-sectional view of an unguided-projectile system according to another embodiment of the invention.

FIG. 17 is a cross-sectional view of the unguided-projectile system of FIG. 16 shortly after firing according to an embodiment of the invention.

FIG. 18 is a diagram of an unmanned vehicle that carries an unguided-projectile system according to another embodiment of the invention.

FIG. 21 is a view of a vessel and an unmanned vehicle such as the vehicle of FIG. 4 or the vehicle of FIG. 18 cooperating to seek and destroy a target according to an embodiment of the invention.

FIG. 22 is a view of unmanned vehicles such as the vehicles of FIGS. 4 and 18 forming a defensive perimeter according to an embodiment of the invention.

DETAILED DESCRIPTION

Figure 1:
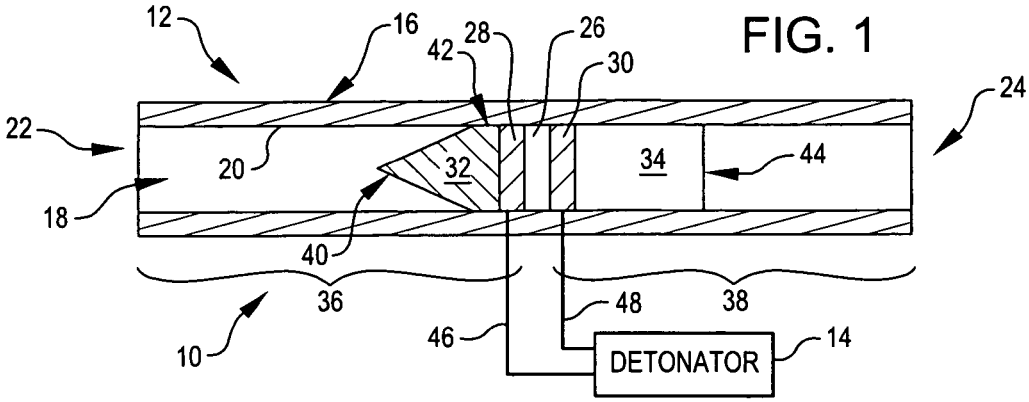
FIG. 1 is a diagram of an unguided-projectile system according to an embodiment of the invention.

FIG. 1 is a diagram of an unguided-projectile system 10, which includes a gun 12 and an electronic detonator 14 according to an embodiment of the invention. As discussed below, the system 10 is suitable for an unmanned vehicle because it is relatively small, recoilless, and relatively inexpensive to maintain, and is suitable for use underwater and in other liquid environments. Moreover, the system 10 fires unguided supercavitating projectiles that have a range substantially greater than conventional unguided projectiles. The system 10 may also include a conventional targeting subsystem (not shown in FIG. 1) for aiming the barrel of the gun 12. Examples of such a targeting subsystem include the targeting subsystems incorporated by unguided-projectile systems manufactured by Metal Storm Ltd. of Brisbane Australia.

The gun 12 includes a cylindrical enclosure, i.e., a barrel 16, which is shown in cross section and which includes chamber 18 having a wall 20 and two open ends 22 and 24. The barrel 16 may be made from steel or other suitable materials, such as those suitable for underwater use.

Inside the chamber 18 of the barrel 16 are disposed a divider 26, charges 28 and 30, a target-striking supercavitating projectile 32, and a recoil-absorbing projectile 34.

The divider 26 divides the barrel 16 into a striking-projectile section 36 and an absorbing-projectile section 38, is integral with the barrel, and has a thickness that is sufficient to prevent the detonation of the charges 28 and 30 from deforming the divider. Alternatively, the divider 26 may be attached (e.g., welded) to the barrel 16, or may be made from a material that is different than the material from which the barrel is made. Furthermore, although shown disposed in the middle of the barrel 16, the divider 26 may be disposed at any location within the barrel.

The charges 28 and 30 may be gunpowder or other charges that, when detonated, respectively propel the projectiles 32 and 34 out of the barrel ends 22 and 24. The charges 28 and 30 and the projectiles 32 and 34 are designed such that if the detonator 14 simultaneously detonates these charges, then ideally the effective momentum—effective momentum is discussed below in conjunction with FIG. 2—of the projectile 32 is the same as that of the projectile 34 such that the barrel 16 experiences little or no recoil. Because the barrel 16 experiences little or no recoil, the gun 12 is often suitable for use on an unmanned vehicle such as that discussed below in conjunction with FIG. 4.

The target-striking projectile 32 is made of metal or another suitable material, and has a tapered, dart-like front end 40, which may reduce drag and facilitate the projectile penetrating a target (not shown in FIG. 1). A back end 42 of the projectile 32 fits snugly against the inner wall 20 of the chamber 18 so as to prevent a fluid, such as water, inside of the chamber from damaging the charge 28.

Similarly, the recoil-absorbing projectile 34 is made of metal or another suitable material. Because the recoil-absorbing projectile 34 is not aimed at a target, it is often desired that the recoil-absorbing projectile travel as short a distance as possible to reduce the probability of this projectile causing unintended consequences. Therefore, the projectile 34 has a flat front end 44, which increases drag and limits the distance that the projectile travels. The projectile 32 fits snugly against the inner wall 20 of the chamber 18 so as to prevent a fluid, such as water, inside of the chamber from leaking past the projectile and damaging the charge 30.

The detonator 14 detonates the charges 28 and 30 by sending an electrical current to the charges via wires 46 and 48, respectively, in response to a firing subsystem (not shown in FIG. 1), which may share the same computer as the targeting subsystem (also not shown in FIG. 1). Consequently, the firing mechanism of the gun 12 has no moving parts, thus allowing the gun to have reduced size, complexity, and cost, and to be more suitable for underwater use as compared to prior guns. The wires 46 and 48 may extend to the charges 28 and 30 via respective openings in the barrel wall 18, or may pass current to the propellants in another manner. Furthermore, the detonator 14 may include or be coupled to a battery or other power source (neither shown in FIG. 1) from which the detonator generates the detonation current.

Figure 2:
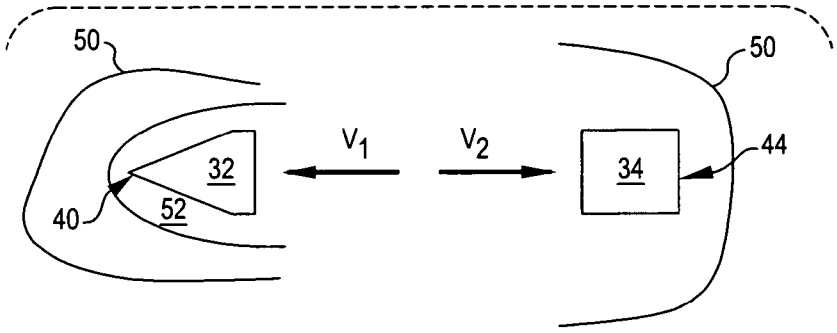
FIG. 2 is a diagram of the target and recoil-absorbing projectiles of FIG. 1 as they travel through a liquid according to an embodiment of the invention.

FIG. 2 is a cross sectional view of the projectiles 32 and 34 of FIG. 1 as they travel through a liquid 50, such as water, according to an embodiment of the invention.

The tapered front end 40 and the size of the propellant 28 (FIG. 1) allow the projectile 32 to achieve a velocity V1, which is sufficient to cavitate a region 52 of the liquid 50 about the projectile. Hence, one may refer to the projectile 32 as a supercavitating projectile. The cavitation region 52 includes a vapor form of the liquid 50, and thus places significantly less drag on the projectile 32 than the liquid 50 would if the cavitation region were not present. Consequently, the cavitation region 52 often allows the projectile 32 to travel significantly farther in the liquid 50 than a projectile about which there is no cavitation region. For example, the cavitation region 52 may allow the projectile 32 to travel one hundred meters or more.

In contrast, the flat front end 44 limits the recoil-absorbing projectile 34 to achieving only a velocity V2 by causing the liquid to place a relatively large drag on this projectile. Consequently, the flat front end 44 significantly limits the distance that the recoil-absorbing projectile 34 travels in the liquid 50 as compared to the distance that the projectile 32 travels. But because the function of the projectile 34 is to absorb the recoil that would otherwise be imparted to the barrel 16 by the charge 28, it is desired to limit the distance that the projectile 34 travels, so as to reduce the chances that this projectile will strike an unintended target or cause another unintended consequence. In one example, the projectile 34 is designed to travel three or fewer meters in the liquid 50 after the projectile exits the barrel 16. Alternatively, although described as a single, solid mass, the recoil-absorbing projectile 34 may be designed to fragment after the detonator 14 detonates the propellant 30, or may be formed as a collection of pellets (similar to buckshot), to further reduce the distance traveled by the projectile 34 (or pieces thereof).

Referring to FIGS. 1 and 2, the operation of the gun 12 is described.

First, one loads the charges 28 and 30 into the chamber 18 of the barrel 16 in a conventional manner.

Next, one loads the projectiles 32 and 34 into the chamber 18.

Then, one installs the loaded barrel 16 into a barrel mount (not shown in FIG. 1), and connects the wires 46 and 48 from the detonator 14 to the charges 28 and 30.

At some time later, a targeting subsystem (not shown in FIG. 1) acquires a target (also not shown in FIG. 1) and aims the front opening 22 of the chamber 18, and thus aims the projectile 32, at the target.

Next, a firing subsystem (not shown in FIG. 1) detonates the charges 28 and 30, which respectively propel the projectile 32 toward the target (not shown in FIG. 1) and propel the recoil-absorbing projectile 34 in a direction opposite to that of the projectile 32. The projectile 32 exits the barrel end 22 and travels toward the target, and the recoil-absorbing projectile 34 exits the barrel end 24 and travels in the opposite direction, as described above in conjunction with FIG. 2. To reduce or eliminate recoil in the barrel 16, the firing subsystem detonates the charges 28 and 30 substantially simultaneously. Detonating the charges 28 and 30 substantially simultaneously allows the force generated on the divider 26 by the detonated charge 30 to substantially cancel the substantially equal opposing force generated on the divider by the detonated charge 28. More specifically, to eliminate recoil, $M_{1effective}$ $V_1$ must equal $M_{2effective}$ $V_2$, where $M_{1effective}$ and $V_1$ are the effective mass and the actual velocity of the projectile 32, and where $M_{2effective}$ and $V_2$ are the effective mass and the actual velocity of the projectile 34. The calculation of the effective mass is known but complex, and typically accounts for the water inside of the gun barrel 16 and some amount of the water entrained in the "muzzle blast" that occurs when the charge detonates. It is theorized that because the effective mass of a ship is about three times the mass of the water that the ship displaces, an upper limit of the effective mass of a projectile, such as the projectiles 32 and 34, exiting a gun barrel is approximately three times the mass of the water that the projectile displaces.

Referring again to FIG. 1, alternative embodiments of the unguided-projectile system 10 are contemplated. For example, the barrel 16 and/or the chamber 18 may be other than cylindrical. Furthermore, the divider 26 may be omitted such that the charges 28 and 30 contact each other, or such that the charges 28 and 30 are combined into a single charge that is detonated via a single wire 46 or 48. In addition, although the charges 28 and 30 are described as detonating entirely within the barrel 16, these propellants may continue detonating outside of the barrel. For example, the projectile 32 may carry the charge 28, and thus be similar to an unguided rocket or missile. Moreover, one can use known mathematical relationships to, e.g., determine the weight of the charge 28 needed to propel the projectile 32 a desired distance, and to determine the reaction of a target (e.g., disabled, destroyed) to the impact of the projectile. And because the weight of the charge 28 may change with depth to provide the desired velocity to the projectile 32, and possibly for other reasons, one may modify the gun 12 (e.g., thicker barrel 16) for different depths. Furthermore, the system 10 may include features such as those disclosed in the following U.S. patents and Patent Publications, which are all incorporated by reference: Pat. Nos. 6,889,935 entitled DIRECTIONAL CONTROL OF MISSILES, issued May 10, 2005, to O'Dwyer; U.S. Pat. No. 6,860,187 entitled PROJECTILE LAUNCHING APPARATUS AND METHODS FOR FIRE FIGHTING, issued Mar. 1, 2005, to O'Dwyer; U.S. Pat. No. 6,782,826 entitled DECOY, issued Aug. 31, 2004, to O'Dwyer; U.S. Pat. No. 6,722,252 entitled PROJECTILE FIRING APPARATUS, issued Apr. 20, 2004, to O'Dwyer; U.S. Pat. No. 6,715,398 entitled BARREL ASSEMBLY FOR FIREARMS, issued Apr. 6, 2004, to O'Dwyer; U.S. Pat. No. 6,701,818 entitled METHOD FOR SEISMIC EXPLORATION OF A REMOTE SITE, issued Mar. 9, 2004, to O'Dwyer; U.S. Pat. No. 6,557,449 entitled FIREARMS, issued May 6, 2003, to O'Dwyer; 6,543,174 entitled BARREL ASSEMBLY WITH OVERPRESSURE RELIEF, issued Apr. 8, 2003, to O'Dwyer; U.S. Pat. No. 6,510,643 entitled BARREL ASSEMBLY WITH AXIALLY STACKED PROJECTILES, issued Jan. 28, 2003, to O'Dwyer; U.S. Pat. No. 6,477,801 entitled FIREARMS SECURITY, issued Nov. 12, 2002, to O'Dwyer; U.S. Pat. No. 6,431,076 entitled FIREARMS, issued Aug. 13, 2002, to O'Dwyer; U.S. Pat. No. 6,343,553 entitled FIREARMS, issued Feb. 5, 2002, to O'Dwyer; U.S. Pat. No. 6,301,819 entitled BARREL ASSEMBLY WITH AXIALLY STACKED PROJECTILES, issued Oct. 16, 2001; to O'Dwyer; U.S. Pat. No. 6,223,642 entitled CANNON FOR AXIALLY FED ROUNDS WITH BREECHED ROUND SEALING BREECH CHAMBER, issued May 1, 2001, to O'Dwyer; U.S. Pat. No. 6,138,395 entitled BARREL ASSEMBLY WITH AXIALLY STACKED PROJECTILES, issued Oct. 31, 2000, to O'Dwyer; U.S. Pat. No. 6,123,007 entitled BARREL ASSEMBLY, issued Sep. 26, 2000, to O'Dwyer; Patent Publication Nos.: US 2005/0022657 entitled PROJECTILE LAUNCHING APPARATUS, published Feb. 3, 2005, to O'Dwyer; US 2004/0237762 entitled SET DEFENSE MEANS, published Dec. 2, 2004, to O'Dwyer; US 2002/0157526 entitled BARREL ASSEMBLY WITH OVER-PRESSURE RELIEF, published Oct. 31, 2002, to O'Dwyer; and US 2002/0152918 entitled FIREARMS, published Oct. 24, 2002, to O'Dwyer.

Figure 3:
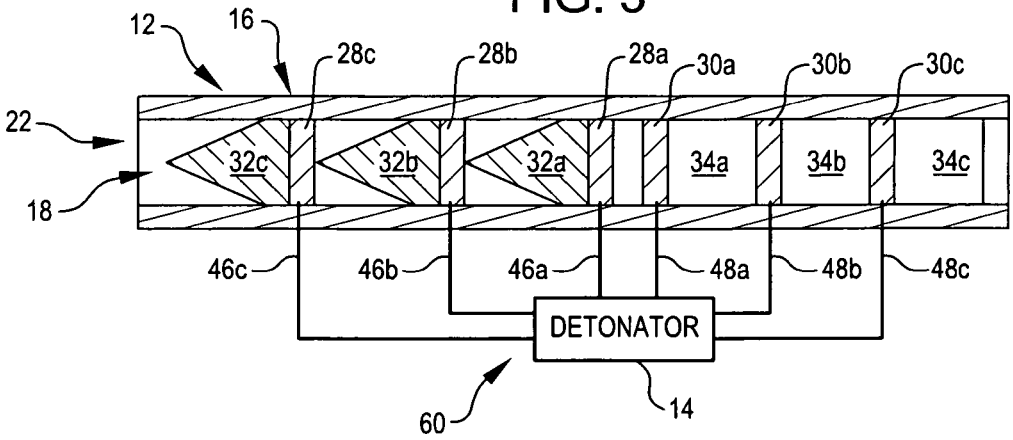
FIG. 3 is a diagram of an unguided-projectile system that can hold multiple rounds of projectiles according to an embodiment of the invention.

FIG. 3 is a diagram of an unguided-projectile system 60 according to another embodiment of the invention, where like components of the system 60 are referenced with the same number as for the system 10 in FIG. 1. The system 60 is similar to the system 10 of FIG. 1, except that the chamber 18 of the barrel 16 holds multiple rounds (here three rounds) of supercavitating and recoil-absorbing projectiles 32*a*-32*c* and 34*a*-34*c* and corresponding charges 28*a*-28*c* and 30*a*-30*c*. Holding multiple rounds of projectiles 30 and 32 increases the fire power of the system 60, and may reduce the frequency at which one reloads the gun 12.

Referring to FIG. 3, the operation of the gun 12 of the system 60 is described according to an embodiment of the invention.

First, one loads the charges 28*a* and 30*a* into the chamber 18 of the barrel 16 in a conventional manner.

Next, one loads the projectiles 32*a* and 34*a* into the chamber 18.

Then, one loads the charges 28*b* and 30*b* and the projectiles 32*b* and 34*b* into the chamber 18, followed by the charges 28*c* and 30*c* and the projectiles 32*c* and 34*c*.

Next, one installs the loaded barrel 16 into a barrel mount (not shown in FIG. 3), and connects the wires 46*a*-46*c* and 48*a*-48*c* from the detonator 14 to the charges 28*a*-28*c* and 30*a*-30*c*, respectively.

At some time later, a targeting subsystem (not shown in FIG. 3) acquires a target (also not shown in FIG. 3) and aims the front opening 22 of the chamber 18, and thus aims the supercavitating projectile 32*c*, at the target.

Then, a firing subsystem (not shown in FIG. 3) detonates the propellants 28*c* and 30*c*, which respectively propel the projectile 32*c* toward the target (not shown in FIG. 3) and the projectile 34*c* in a direction opposite to that of the projectile 32*c*. To reduce or eliminate recoil in the barrel 16, the firing subsystem detonates the charges 28*c* and 30*c* substantially simultaneously in a manner similar to that described above in conjunction with FIGS. 1-2.

Next, the targeting subsystem (not shown in FIG. 3) reacquires the previous target (if necessary) or a new target (also not shown in FIG. 3), and re-aims the front opening 22 of the chamber 18 at the previous target or aims the front opening at the new target.

Then, the firing subsystem (not shown in FIG. 3) detonates the charges 28*b* and 30*b*, which respectively propel the projectile 32*b* toward the previous target or new target (neither shown in FIG. 3) and the projectile 34*b* in a direction opposite to that of the projectile 32*b*. To reduce or eliminate recoil in the barrel 16, the firing subsystem detonates the charges 28*b* and 30*b* substantially simultaneously as discussed above for the charges 28*c* and 30*c*.

Next, the targeting subsystem (not shown in FIG. 3) reacquires the previous target (if necessary) or a new target (also not shown in FIG. 3), and re-aims the front opening 22 of the chamber 18 at the previous target or aims the front opening at the new target.

Then, the firing subsystem (not shown in FIG. 3) detonates the charges 28*a* and 30*a*, which respectively propel the projectile 32*a* toward the previous target or new target (neither shown in FIG. 3) and the projectile 34*a* in a direction opposite to that of the projectile 32*a*. To reduce or eliminate recoil in the barrel 16, the firing subsystem detonates the charges 28*a* and 30*a* substantially simultaneously as discussed above for the charges 28*c* and 30*c*.

Referring again to FIG. 3, alternative embodiments of the system 60 are contemplated. For example, alternative embodiments similar to those discussed above for the system 10 of FIG. 1 are contemplated. Furthermore, the chamber 18 may hold two or more than three rounds of the projectiles 32 and 34. In addition, one may load the chamber with different types of projectiles 32 and 34, and different types or sizes of the charges 28 and 30. But in one embodiment, corresponding groupings of projectiles 32 and 34 (e.g., projectiles 32*b* and 34*b*) and charges 28 and 30 (e.g., charges 28*b* and 30*b*) are designed such that when the charges are detonated substantially simultaneously, the barrel 16 experiences little or no recoil.

Figure 4:
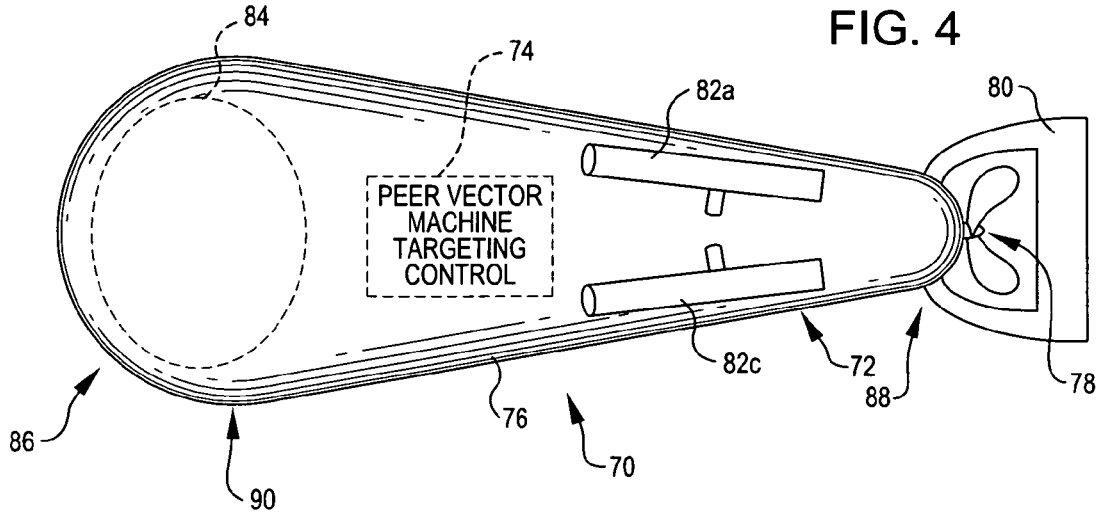
FIG. 4 is a diagram of an unmanned vehicle that carries an unguided-projectile system according to an embodiment of the invention.

FIG. 4 is a view of an unmanned underwater vehicle 70, which includes an unguided-projectile system 72 and a peer-vector computing machine 74 according to an embodiment of the invention. Because the vehicle 70 includes an unguided-projectile system, the vehicle can often seek, acquire, and disable or destroy a target without destroying itself or the unguided-projectile system 72. Consequently, the system 72 may render the vehicle 70 less costly over time than a fleet of guided-projectile systems, such as torpedoes, that typically destroy themselves while disabling or destroying targets.

The vehicle 70 is shaped like a torpedo, and, in addition to the system 72 and computing machine 74, includes a hull 76, a propulsion device (here a propeller 78) and a rudder 80. Although omitted from FIG. 4, the vehicle 70 may also include a motor for driving the propeller 78, a steering mechanism for moving the rudder 80, a buoyancy system for setting the vehicle's depth, a guidance system that is self contained and/or communicates with a remote command center such as on board the ship that launched the vehicle, a power-supply system, or other conventional components and systems. The computing machine 74 may partially or fully control some or all of the above-described components and systems.

The unguided-projectile system 72 includes guns 82*a*-82*n* (only guns 82*a*-82*c* shown in FIG. 4) mounted to the outside of the hull 76 of the vehicle 70. Each of the guns 82 may be the same as or similar to the recoilless single-round gun 12 of FIG. 1 or the recoilless multiple-round gun 12 of FIG. 3. Although the guns 82 are shown as being stationary relative to the hull 76, the guns may be mounted with mechanical arms (not shown in FIG. 4) or another mechanism that can move the guns relative to the hull.

The unguided-projectile system 72 also includes a sonar array 84 for generating and receiving signals that the computing machine 74 processes to detect and acquire a target (not shown in FIG. 4). Although the array 84 is shown as including a single section mounted to a nose 86 of the hull 76, the array may be mounted on another portion of the hull, or may include multiple sections (not shown) that are each mounted to a respective portion of the hull. For example, the array 84 may include a section mounted to the nose 86 of the hull 76, a section mounted to a rear 88 of the hull, and four sections each mounted equidistantly around a front portion 90 of the hull. Furthermore, the sonar array 84 may be separate and distinct from a sonar array that is part of the vehicle's guidance system (not shown in FIG. 4), or the projectile system 72 and the vehicle's guidance system may share the array 84.

Figure 5:
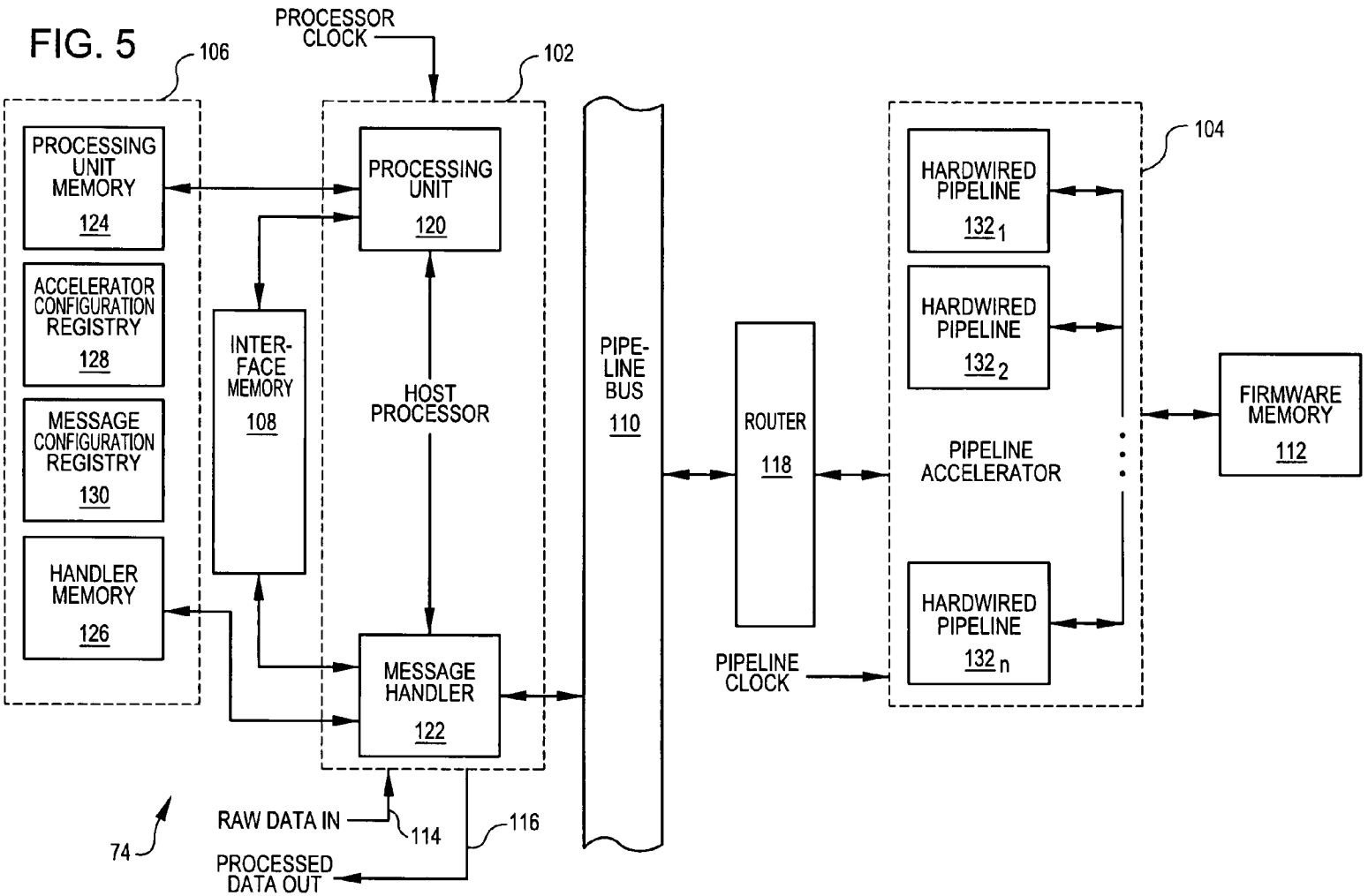
FIG. 5 is a schematic block diagram of the computing machine of FIG. 4 according to an embodiment of the invention.

The peer-vector computing machine 74, which is further described below in conjunction with FIG. 5, is powerful enough to provide the processing power that the projectile system 72, the guidance system (not shown in FIG. 4), and the other systems (not shown in FIG. 4) of the unmanned vehicle 70 require, yet is sufficiently small and energy efficient to fit within the hull 76 and run off of the vehicle's power-supply system (not shown in FIG. 4), which may be a battery. As an alternative to a single peer-vector computing machine 74 servicing both the projectile system 72 and the guidance and other systems of the vehicle 70, the vehicle may include multiple peer-vector computing machines: one dedicated to the projectile system, and the other(s) dedicated to the guidance and other systems, or, the vehicle 70 may include a combination of one or more peer-vector computer machines and one or more conventional processor-based computer machines.

Alternate embodiments of the vehicle 70 are contemplated. For example, although the guns 82 are shown pointed in the same direction, the guns 82 may point in different directions. That is, some guns 82 may point toward the nose 86 of the vehicle 70, and others may point to the rear 88 of the vehicle. Moreover, although the vehicle 70 is described as suited for underwater operation, similar vehicles may be designed for operation in other environments, such as ground, air, and outer space. In addition, the vehicle 70 may have a shape other than that of a torpedo.

FIG. 5 is a schematic block diagram of the peer-vector computing machine 74 of FIG. 4 according to an embodiment of the invention. In addition to a host processor 102, the peer-vector machine 74 includes a pipeline accelerator 104, which is operable to process at least a portion of the data processed by the machine 74. Therefore, the host-processor 102 and the accelerator 104 are "peers" that can transfer data messages back and forth. Because the accelerator 104 includes hardwired logic circuits instantiated on one or more programmable-logic integrated circuits (PLICs), it executes few, if any, program instructions in the traditional sense (e.g., fetch an instruction, load the fetched instruction into an instruction register), and thus typically performs mathematically intensive operations on data significantly faster than a bank of instruction-executing computer processors can for a given clock frequency. Consequently, by combining the decision-making ability of the processor 102 and the number-crunching ability of the accelerator 104, the machine 74 has the same abilities as, but can often process data faster than, a conventional processor-based computing machine. Furthermore, as discussed below and in U.S. Patent Publication No. 2004/0136241, which is incorporated by reference, providing the accelerator 104 with a communication interface that is compatible with the interface of the host processor 102 facilitates the design and modification of the machine 74, particularly where the communication interface is an industry standard. In addition, for a given data-processing power, the computing machine 74 is often smaller and more energy efficient than a processor-based computing machine. Moreover, the machine 74 may also provide other advantages as described in the following other patent publications and applications, which are incorporated by reference: Publication Nos. 2004/0133763, 2004/0181621, 2004/0170070, 2004/0130927, 2006/0087450, 2006/0230377, 2006/0149920, 2006/0101250, 2006/0101307, 2006/0123282, 2006/0085781, and, 2006/0101253, all filed on Oct. 3, 2005.

Still referring to FIG. 5, in addition to the host processor 102 and the pipeline accelerator 104, the peer-vector computing machine 74 includes a processor memory 106, an interface memory 108, a bus 110, a firmware memory 112, an optional raw-data input port 114, an optional processed-data output port 116, and an optional router 118.

The host processor 102 includes a processing unit 120 and a message handler 122, and the processor memory 106 includes a processing-unit memory 124 and a handler memory 126, which respectively serve as both program and working memories for the processor unit and the message handler. The processor memory 124 also includes an accelerator-configuration registry 128 and a message-configuration registry 130, which store respective configuration data that allow the host processor 102 to configure the functioning of the accelerator 104 and the structure of the messages that the message handler 122 sends and receives.

The pipeline accelerator 104 includes at least one PLIC, such as a field-programmable gate array (FPGA), on which are disposed hardwired pipelines $\mathbf{132}_1$-$\mathbf{132}_n$, which process respective data while executing few, if any, program instructions in the traditional sense. The firmware memory 112 stores the configuration firmware for the PLIC(s) of the accelerator 104. If the accelerator 104 is disposed on multiple PLICs, these PLICs and their respective firmware memories may be disposed on multiple circuit boards that are often called daughter cards or pipeline units. The accelerator 104 and pipeline units are discussed further in previously incorporated U.S. Patent Publication Nos. 2004/0136241, 2004/0181621, and 2004/0130927.

Generally, in one mode of operation of the peer-vector computing machine 74, the pipelined accelerator 104 receives data from one or more software applications running on the host processor 102, processes this data in a pipelined fashion with one or more logic circuits that execute one or more mathematical algorithms, and then returns the resulting data to the application(s). As stated above, because the logic circuits execute few if any software instructions in the traditional sense, they often process data one or more orders of magnitude faster than the host processor 102. Furthermore, because the logic circuits are instantiated on one or more PLICs, one can modify these circuits merely by modifying the firmware stored in the memory 112; that is, one need not modify the hardware components of the accelerator 104 or the interconnections between these components. The operation of the peer-vector machine 74 is further discussed in previously incorporated U.S. Patent Publication No. 2004/0133763, the functional topology and operation of the host processor 102 is further discussed in previously incorporated U.S. Patent Publication No. 2004/0181621, and the topology and operation of the accelerator 104 is further discussed in previously incorporated U.S. Patent Publication No. 2004/0136241.

Figure 6:
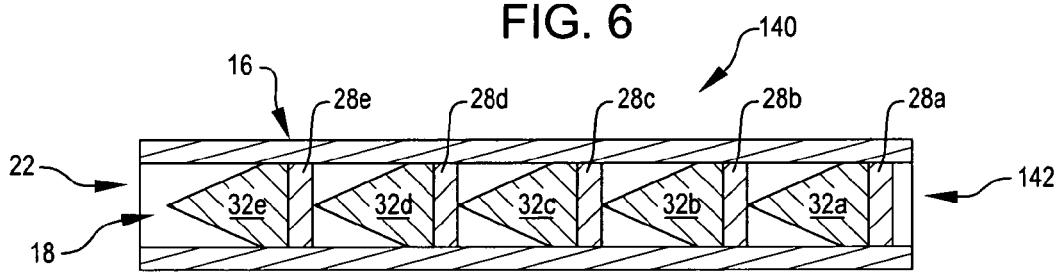
FIG. 6 is a block diagram of the unguided-projectile system of FIG. 4 according to another embodiment of the invention.

FIG. 6 is a cut-away side view of a gun 140, which can replace one or more of the guns 82 on the vehicle 70 of FIG. 4 according to an embodiment of the invention. The gun 140 is similar to the gun 12 of FIG. 3 except that the gun 140 is not recoilless. But for given barrel and supercavitating-projectile lengths, the gun 140 can hold more supercavitating projectiles than the gun 12 of FIG. 3.

Like the gun 12 of FIG. 3, the gun 140 includes a barrel 16 having a chamber 18 with an open end 22 through which one may load supercavitating projectiles 32*a*-32*e* and charges 28*a*-28*e* into the chamber. But unlike the gun 12 of FIG. 3, the gun 140 includes a closed end 142. Therefore, when a charge 28 detonates, it causes the barrel 16 to recoil in a direction opposite to that in which the fired projectile 32 travels.

To absorb the recoil that occurs when the gun 140 is fired, the gun may be mounted to the hull 76 of the vehicle 70 (FIG. 4) using a conventional recoil-absorbing technique such as one of those described below in conjunction with FIGS. 12-17.

Alternatively, if the vehicle 70 (FIG. 4) includes multiple guns 140, these guns may be mounted and fired to lessen the recoil affect. For example, if two guns 140 pointing in the same direction are mounted on opposite sides (180° apart) of the hull 76 and fire projectiles 32 substantially simultaneously, then although the recoil may force the vehicle 70 substantially straight backward (assuming the projectiles 32 and charges are mass velocity balanced per above), the guns 140 (and possible other guns on the vehicle 70) may remain aimed at the target (not shown in FIG. 4 or 6). In addition, the propeller 78 or other propulsion unit (not shown in FIG. 4 or 6) may generate a force that partially or fully counteracts the recoil, thus limiting or eliminating the backward movement of the vehicle 70. Or, if two guns 140 are mounted on a same side of the hull 70 but are pointed in opposite directions, then the vehicle 70 may experience little or no recoil.

Still referring to FIG. 6, the gun 140 may include features that are similar to features of guns manufactured by Metal Storm, Ltd., of Brisbane, Australia.

Figure 7:
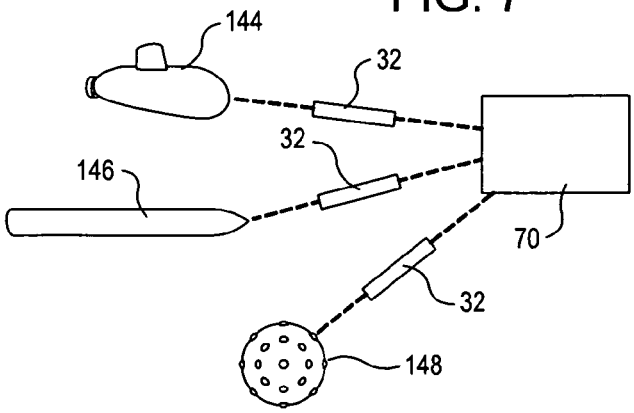
FIG. 7 is a diagram of the unmanned vehicle of FIG. 4 destroying underwater targets with unguided projectiles according to an embodiment of the invention.

FIG. 7 is a diagram showing the vehicle 70 of FIG. 4 firing supercavitating projectiles 32 at multiple targets, including an enemy submarine 144, an incoming torpedo 146 and a mine 148, according to an embodiment of the invention.

Referring to FIGS. 1-2, 4, and 7, the operation of the vehicle 70 is described.

First, one loads the supercavitating projectiles 32 and charges 28 into the guns 82. If the guns 82 are recoilless like the guns 12 of FIGS. 1 and 3, then he also loads the recoil-absorbing projectiles 34 and charges 30 into the guns 82.

Next, one prepares the vehicle 70 for launching.

Then, one launches the vehicle 70, for example, from a conventional torpedo tube on a submarine.

Next, the projectile system 72 searches for a target, for example, the mine 148. For example, the peer-vector computing machine 74 causes the sonar array 84 to transmit sonar signals, and to receive portions of these signals reflected from objects in the paths of the transmitted signals. The computing machine 74 then processes these reflected signals using one or more conventional algorithms to determine if one or more of the objects are targets. Alternatively, other sonar techniques, such as bistatic active or passive techniques, may be used. Or, laser radar (LADAR) may be used. The computing machine 74 continues this process until it identifies a target. Alternatively, a human operator on the launching ship (not shown in FIG. 7) may monitor this data to assist in determining which, if any, of these objects is a target. The vehicle 70 may communicate with the launching ship (via a cable that composes a part of a tether, via the sonar array 86, or via any other means).

Then, the peer-vector computing machine 74 controls the propeller 78 and the rudder 80 so as to maneuver the vehicle 70 into range of the target.

Next, the peer-vector computing machine 74 aims one or more of the guns 82 at the target. If the guns 82 are immovable relative to the hull 76, then the computing machine 74 controls the propeller 78 and rudder 80 so as to maneuver the vehicle 70 into a position in which one or more of the guns are aimed at the target. Alternatively, if the guns 82 are moveable relative to the hull 76, then the computing machine 74 may cause only the guns to move, or may both move the guns and maneuver the vehicle 70 into a desired position. Furthermore, if the target is moving, then the computing machine 74 may cause the one or more guns 82 and/or the vehicle 70 to move so as to track the movement of the target.

Then, the peer-vector computing machine 74 determines the number of projectiles 32, the firing sequence of the guns 82 (if multiple guns are to be fired), and the time between firing each of the projectiles needed for the desired affect (e.g., disable, destroy) on the target. For example, for a single mine 148, the computing machine 74 may determine that two projectiles 32 fired one second apart are sufficient for ensuring that the mine is destroyed. The computing machine 74 may make this determination using one or more conventional algorithms. More specifically, because the cavitation region 52 may behave somewhat unpredictably and thus cause the projectile 32 to veer from its intended trajectory (particularly for a projectile 32 fired into the wake of a previously fired projectile) and because the aiming may be somewhat inaccurate (particularly as to the target's depth), the computing machine 74 may fire multiple projectiles 32 to increase the probability that at least one projectile hits the target. For example, although a hit by a single projectile 32 may be sufficient to destroy a mine 148, the computing machine 74 may fire multiple projectiles to increase to a predetermined level the probability that at least one projectile actually hits the mine. To make this determination, the computer machine 74 executes an algorithm that accounts for, e.g. the level of error in the aiming of the gun(s) and the distance from the vehicle 70 to the target.

Next, the peer-vector computing machine 74 causes the detonator 14 to fire the one or more projectiles from the one or more guns 82 in the determined sequence and at the determined time interval(s).

Then, the peer-vector computing machine 74 processes sonar signals received by the array 84 to determine if the target is disabled/destroyed. Alternatively, other sonar techniques or target-detecting techniques (e.g. LADAR) may be used as discussed above. Or, because determining whether a target is disabled or destroyed may be a complex process, a human operator may make this determination based on the available data and/or with the aid of the computing machine 74.

If the peer-vector computing machine 74 determines that the target is not disabled/destroyed, then the machine 74 re-aims (if necessary) and refires the one or more guns 82 until the target is destroyed.

If, however, the peer-vector computing machine 74 determines that the target is disabled/destroyed, then the computing machine searches for another target, or causes the vehicle 70 to travel to a predetermined location, such as the launch ship or site. For example, if the vehicle 70 is to destroy multiple incoming torpedoes, then after the first torpedo is destroyed, the peer-vector computing machine 74 searches for and finds the next torpedo, aims the one or more of the guns 82 and/or maneuvers the vehicle 70 into position, and causes the detonator 14 to fire one or more projectiles 32 at the next torpedo until it is destroyed. The computing machine 74 continues in this manner until all of the incoming torpedoes are destroyed.

Still referring to FIGS. 1-2, 4, and 7, alternative embodiments of the operation of the vehicle 70 are contemplated. For example, a remote system, such as a computer system on board the ship that launched the vehicle 70, may perform the target-detecting function, the target-aiming function, the projectile-firing function, or any other function described above as being performed by the peer-vector computing machine 74. In an extreme example, the peer-vector computing machine 74 may be omitted, and the remote system (which may itself include a peer-vector computing machine) may fully control the operation of the vehicle 70. The remote system may communicate with the vehicle 70 via a fiber-optic or other cable that is part of a line that tethers the vehicle to the launching ship, or with sonar signals via the sonar array 84. Furthermore, as discussed above, the peer-vector computing machine 74 (or the remote system) may cause one or more of the guns 82 to fire a spread of projectiles 32 to insure that at least one projectile hits the target. The computing machine 74 may generate such a spread by firing guns 82 on multiple sides of the vehicle 70, or by moving the guns 82 slightly in between the firing of multiple rounds of the projectiles 32.

FIGS. 8-11 illustrate an application of the vehicle 70 according to an embodiment of the invention. In this embodiment, a ship, such as a "friendly" submarine 150, launches the vehicle 70 together with a torpedo 152, and the vehicle assists the torpedo in disabling or destroying a target, such as an enemy submarine 154, which is located in a littoral environment (i.e., near shore and/or in shallow-water). By using the vehicle 70 instead of or in addition to the friendly submarine 150 to determine the location of the enemy submarine 154, the friendly submarine is less likely to inadvertently disclose its location.

Figure 8:
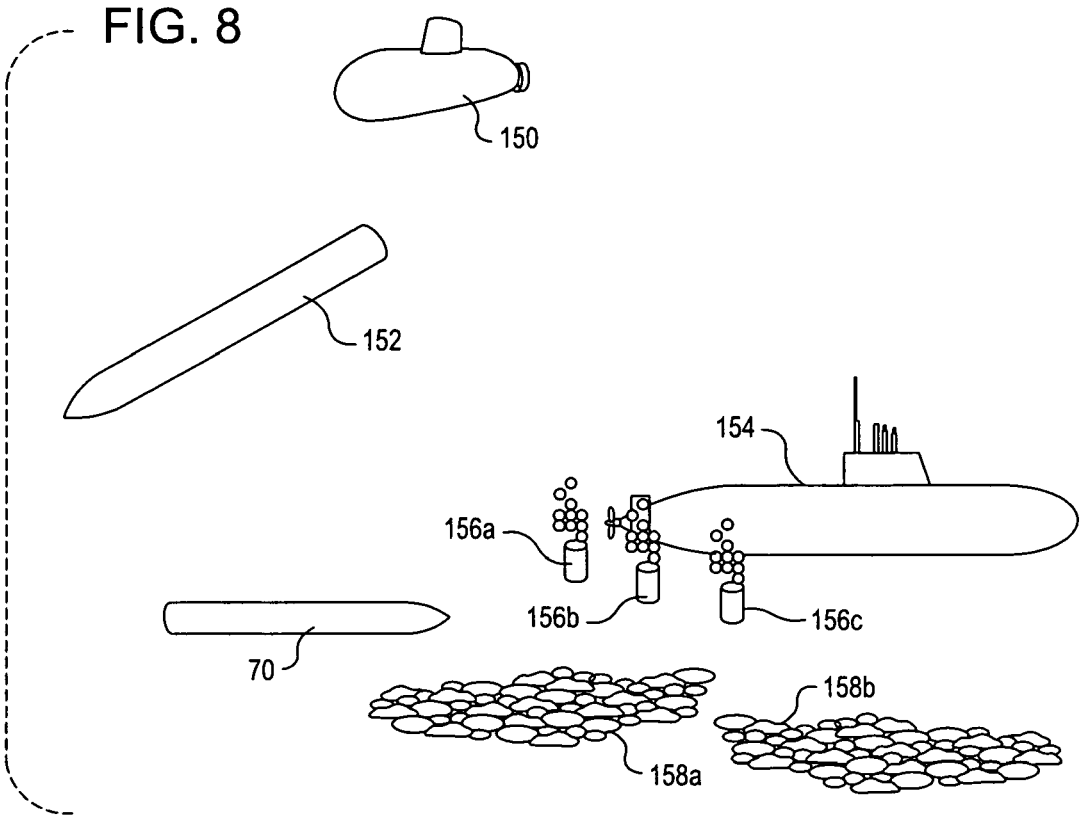
FIGS. 8-11 illustrate an application of the unmanned vehicle of FIG. 4 according to an embodiment of the invention.

Referring to FIGS. 4 and 8, the friendly submarine 150 detects the enemy submarine 154.

Next, the friendly submarine 150 launches the vehicle 70, and at the same time or at some time thereafter, launches the torpedo 152. In response to the friendly submarine 150 launching the vehicle 70 and/or the torpedo 152, the enemy submarine 154 launches one or more counter measures, here three counter measures 156*a*-156*c*, to interfere with sonar signals used to guide the torpedo 152 such that the torpedo misses, and thus does not disable or destroy, the enemy submarine. For example, the counter measures 156 may emit "noise" that interferes with or otherwise masks sonar signals reflected from the enemy submarine 154.

Then, the peer-vector computing machine 74 causes the sonar array 84 to transmit a spread of sonar signals, and, according to one or more conventional algorithms, processes the reflected portions of these signals received by the array to map objects and formations in the water and on the sea floor and to detect the counter measures 156. For example, the computing machine 74 maps rock beds 158*a* and 158*b* on the sea floor.

Next, the peer-vector computing machine 74 transmits the sea-floor map and the positions of the counter measures 156 to the torpedo 152, and the guidance system (not shown in FIGS. 8-11) of the torpedo uses this information to distinguish the enemy submarine 154 and the countermeasures 156 from each other and from any objects or formations, such as the rock beds 158*b* or 158*a*. The computing machine 74 may transmit this information directly to the torpedo 152 via the sonar array 84 and the torpedo's sonar array (not shown in FIGS. 8-11), or indirectly via the friendly submarine 150. The computing machine 74 may transmit this and other information to the submarine 150 via the sonar array 84 and the friendly submarine's sonar array (not shown in FIGS. 8-11), or via a fiber optic or other cable that forms part of a line (not shown in FIGS. 8-11) that tethers the vehicle 70 to the friendly submarine.

Figure 9:
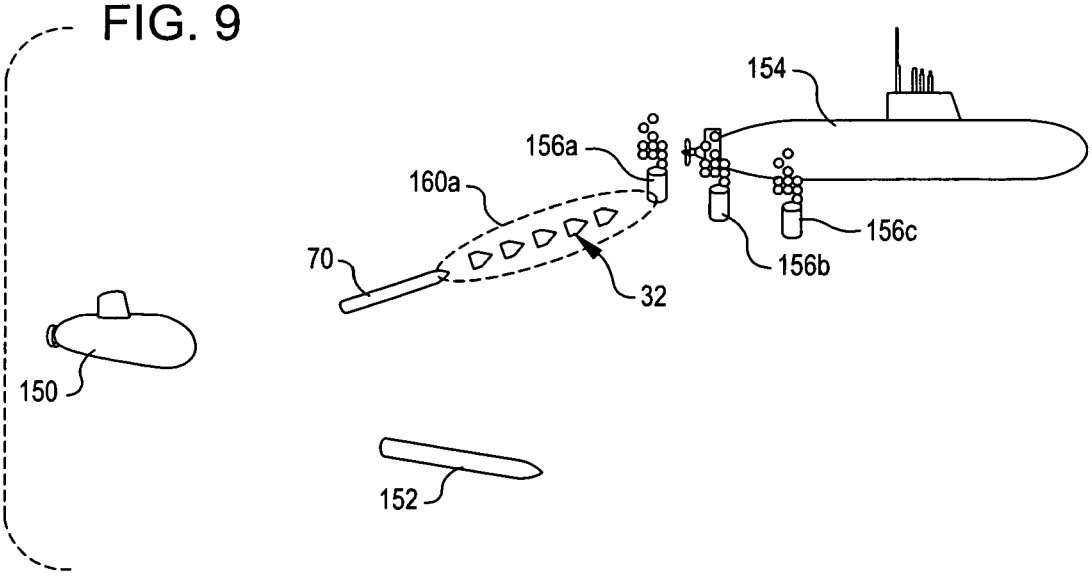

Referring to FIGS. 4 and 9, the peer-vector computing machine 74 then aims one or more of the guns 82 at the first counter measure 156*a*, and fires a volley of projectiles 32 to destroy the first counter measure. The computing machine 74 may cause the sonar array 84 to emit ultra-high-frequency sonar signals and to receive the reflections of these signals from the first counter measure 156*a* to more precisely locate the first counter measure, and thus to more precisely aim the one or more of the guns 82. Furthermore, the computing machine 74 continues to map the region and to provide this information to the torpedo 152. Although the trail of bubbles and other noise (not shown in FIG. 4 or 8-11) generated by the supercavitating projectiles 32 may add to the interference generated by the first counter measure 156*a* (and perhaps add to the interference generated by the second and/or third counter measures 156*b* and 156*c*) in a region 160*a*, this trail will typically dissipate quickly enough such that after the destruction of one or more of the counter measures 156, the guidance system of the torpedo 152 can more easily determine the location of the enemy submarine 154

Figure 10:
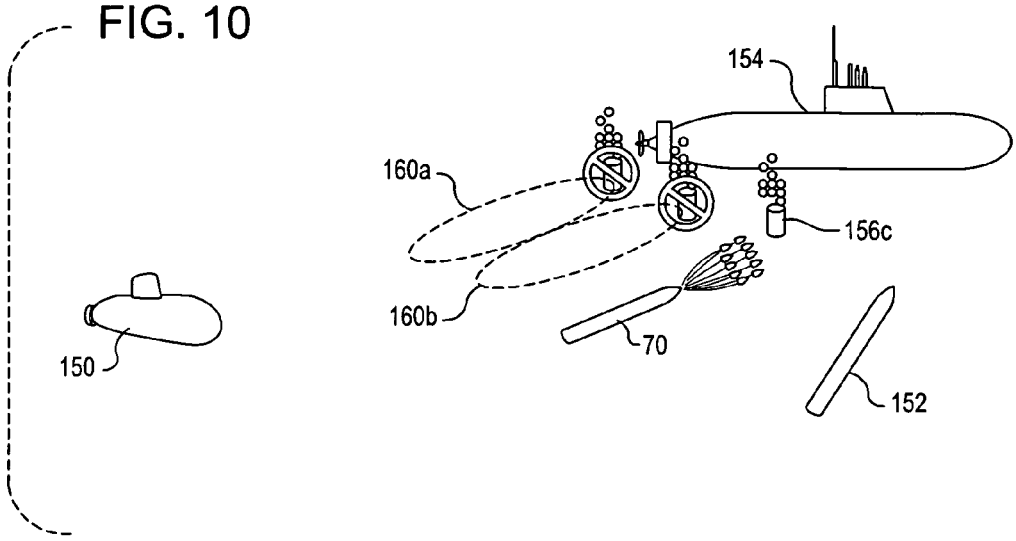

Referring to FIGS. 4 and 10, the peer-vector computing machine 74 next aims one or more of the guns 82 at the second counter measure 156*b*, fires a volley of projectiles 32 to destroy the second counter measure and to generate a degraded region 160*b*, and continues to map the region and to provide this information to the torpedo 152 per the preceding paragraph.

Figure 11:
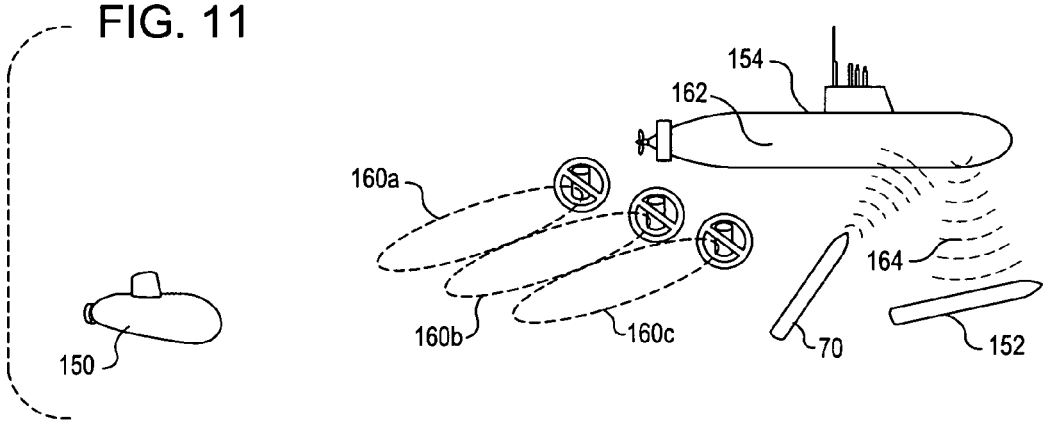

Referring to FIGS. 4 and 11, the peer-vector computing machine 74 then aims one or more of the guns 82 at the third counter measure 156*c*, fires a volley of projectiles 32 to destroy the third counter measure and to generate a degraded region 160*c*, and continues to map the area and to provide this information to the torpedo 152 per the preceding two paragraphs above.

Next, the peer-vector computing machine 74 causes the sonar array 84 to emit sonar signals 162 toward the enemy submarine 154, and the sonar array (not shown in FIGS. 8-11) of the torpedo 152 receives and processes conventional bistatic active echoes reflected by the enemy submarine. The torpedo's guidance system (not shown in FIGS. 8-11) processes these reflections to identify low Doppler target echoes 164, and maneuvers the torpedo 152 toward and into the enemy submarine 154 based on these echoes. Finding low Doppler target echoes is suitable in this situation because the enemy submarine 154 is either stationary or moving slowly because of the littoral environment. More specifically, in a littoral environment, the torpedo's guidance system (which may include a peer-vector machine) executes a classification algorithm to distinguish the enemy submarine 154 (which here is relatively slow moving) from non-target objects such as fish and rocks, so that the torpedo is not "wasted" on one of these non-target objects. The classification algorithm may use the described Doppler analysis as one of its components.

Referring to FIGS. 4 and 8-11, alternate embodiments of the above-described application of the vehicle 70 are contemplated. For example, the friendly submarine 150 can remotely control some or all of the operations of the vehicle 70 and/or the torpedo 152. Furthermore, although the use of certain types of sonar techniques are described for mapping, detecting, and aiming, other sonar techniques or non-sonar techniques such as LADAR may be used for one or more of these tasks.

Figure 12:
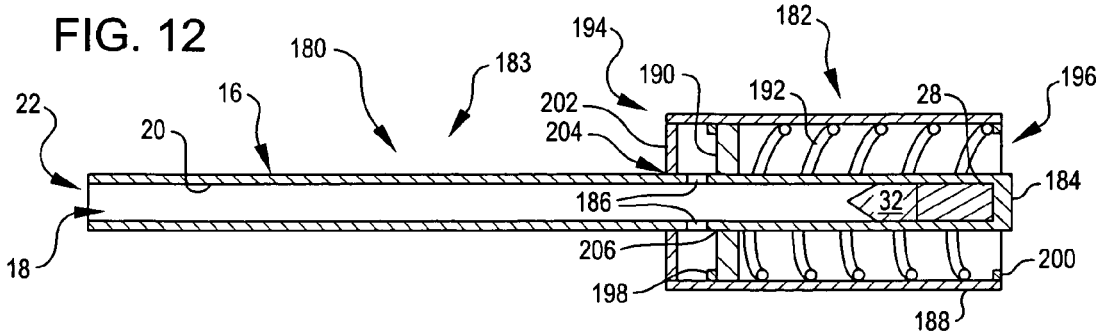
FIG. 12 is a cross-sectional view of an unguided-projectile system according to another embodiment of the invention.

FIG. 12 is a cross-sectional view of an embodiment of an unguided-projectile system 180, where like numbers refer to components common to FIGS. 1-3 and 6, and where the detonator 14 (FIGS. 1 and 3) has been omitted for clarity. The system 180 may be similar in structure and operation to the unguided-projectile systems 10 and 60 of FIGS. 1 and 3, except that a recoil-absorbing mechanism 182 replaces the recoil-absorbing projectiles 34. Like the systems 10 and 60, the system 180 may be suitable for an unmanned vehicle, such as the unmanned vehicle 70 of FIG. 4, because the system is relatively small, substantially recoilless, and relatively inexpensive to maintain, and may be suitable for use underwater and in other liquid environments. Moreover, the system 180 fires unguided supercavitating projectiles 32 that have an underwater range substantially greater than conventional unguided projectiles. The system 180 may also include a conventional targeting subsystem (not shown in FIG. 12) for aiming the barrel 16. Examples of such a targeting subsystem include the targeting subsystems incorporated by unguided-projectile systems manufactured by Metal Storm Ltd. of Brisbane Australia.

Still referring to FIG. 12, a gun 183 of the system 180 includes an inner cylindrical enclosure, i.e., the inner barrel 16, which is shown in cross section and which includes the chamber 18 having the wall 20, the open end 22, a closed end 184, and an exhaust-gas-discharge port 186. Although in this embodiment the port 186 is shown as including two openings in the barrel 16, the port may include fewer or more openings in the barrel. Inside the chamber 18 of the barrel 16 are disposed one or more charges 28 and a corresponding number of target-striking supercavitating projectiles 32. For clarity, only one charge 28 and one projectile 32 are shown. Where multiple charges 28 and projectiles 32 are disposed within the barrel 16, they may be "stacked" like the charges 28*a*-28*e* and the projectiles 32*a*-32*e* in the gun 140 of FIG. 6.

The system 180 also includes the recoil-absorbing mechanism 182, which includes an outer cylindrical enclosure, i.e., outer barrel 188, a piston 190, and a return spring 192.

The outer barrel 188 has a closed first end 194, an open second end 196, piston stop 198, and spring stop 200. The closed first end 194 includes an end cap 202 having an opening 204 through which the inner barrel 16 extends. The opening 204 may be attached to or integral with the inner barrel 16 such that a fluid-tight seal is formed between the end cap 202 and the inner barrel, and such that the inner barrel does not move relative to the outer barrel 188 during the firing of the gun 12. Although not shown in FIG. 12, one may attach the gun 12 to a vehicle or other apparatus by attaching the outer barrel 188 to the vehicle or apparatus.

The piston 190 has an opening 206 through which the inner barrel 16 extends and which forms an inner fluid-tight seal between the piston 190 and the inner barrel. Similarly, the outer edge of the piston 190 forms an outer fluid-tight seal with the inner wall of the outer barrel 188. The inner and outer fluid-tight seals allow the piston 190 to slide back and forth within the barrel 188 and the piston stop 198 prevents the piston 190 from sliding beyond the exhaust-gas discharge port 186.

The return spring 192, which is disposed between the piston stop 198 and the spring stop 200, urges the piston 190 toward and against the piston stop.

Figure 13:
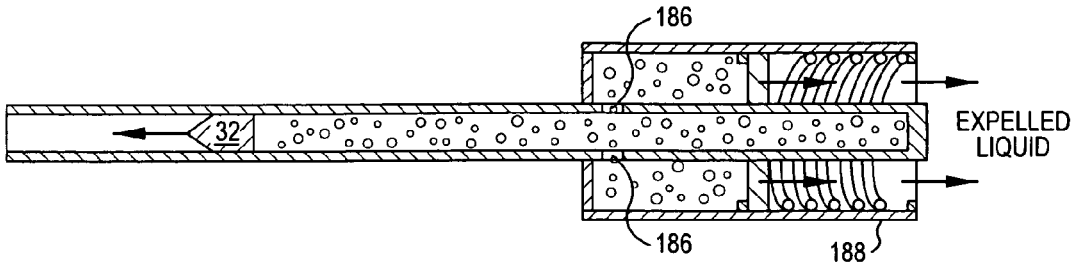
FIG. 13 is a cross-sectional view of the unguided-projectile system of FIG. 12 shortly after firing according to an embodiment of the invention.

FIG. 13 is a cross-sectional view of the unguided-projectile system 180 of FIG. 12 shortly after the detonation of the charge 28 according to an embodiment of the invention.

Referring to FIGS. 12-13, operation of the recoil-absorbing mechanism 182 is discussed where the gun 183 is disposed and fired in a liquid environment such as underwater according to an embodiment of the invention.

The detonation of the charge 28 generates a hot gas 208, which expands within the chamber 18 of the inner barrel 16; this expanding gas is what propels the projectile 32 out of the inner barrel.

As the projectile 32 moves down the inner barrel 16 past the exhaust-gas discharge port 186, a portion of the expanding gas 208 exits the port and forces the piston 190 toward the back end 196 of the outer barrel 188.

As the piston 190 moves, it forces liquid out of the open back end 196 of the outer barrel 188.

In a manner similar to that discussed above in conjunction with FIGS. 1-3, the momentum (the product of the velocity and effective mass) of the liquid exiting the outer barrel 188 counteracts some or all of the momentum of the projectile 32, and thus absorbs some or all of the recoil resulting from the firing of the projectile. Knowing the properties of the charge 28, the projectile 32, and the liquid, one can use known mathematical relationships to calculate, e.g., the volume of the outer barrel 188 and the location of the discharge port 186 that provide a desired level of recoil absorption.

After the projectile 32 exits the inner barrel 16, the pressure generated within the outer barrel 188 by the gas 208 quickly dissipates, and, in response, the spring 192 urges the piston 190 back toward the piston stop 198. Generally, the stiffer the spring 192, the faster the spring moves the piston 190 back to the piston stop 198, and, thus, the faster the mechanism 182 is in position for the firing of the next projectile 32. But as the stiffness of the spring 192 increases, the amount of recoil absorbed by the mechanism 182 generally decreases. Consequently, there may be a tradeoff between the rate at which one can fire the gun 183 and the amount of recoil that the mechanism 182 can absorb.

Next, additional projectiles 32 (not shown in FIGS. 12-13) may be fired either before or after the spring 192 urges the piston 190 back against the piston stop 198. But firing a projectile 32 before the piston 190 is back against the stop 198 may reduce the amount of recoil that the mechanism 182 absorbs as compared to the amount of recoil absorbed when the piston is against the stop 198 when the projectile is fired.

Still referring to FIGS. 12-13, in an embodiment of the system 180 where multiple charges 28 and projectiles 32 are "stacked" in the inner barrel 16 such as shown in FIG. 6, multiple discharge ports 186 may be located at different axial locations along the inner barrel. It is theorized that the distance between the port 186 and the detonated charge may affect the amount of recoil that the mechanism 182 absorbs. Therefore, the barrel 16 may include one port 186 (or multiple ports at the same axial location) per charge 28, where each port is the same predetermined distance from its corresponding charge. Such an arrangement may reduce or eliminate differences in the recoil-absorption level of the mechanism 182 from firing to firing. Alternatively, the inner barrel 16 may include a single port 186 (or multiple ports at a single location) that is between the front end 22 and the charges 28.

Figure 14:
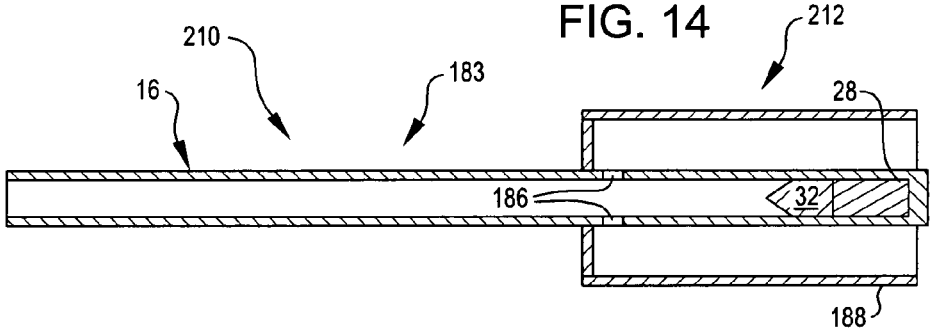
FIG. 14 is a cross-sectional view of an unguided-projectile system according to another embodiment of the invention.

FIG. 14 is a cross-sectional view of an unguided-projectile system 210 according to an embodiment of the invention, where like numbers refer to components common to FIGS. 1-3, 6, and 12-13, and where the detonator 14 (FIGS. 1 and 3) has been omitted for clarity. The system 210 may be similar in structure and operation to the unguided-projectile system 180 of FIGS. 12-13, except that it includes a recoil-absorbing mechanism 212, which lacks the piston 190, spring 192, and stops 198 and 200. Like the system 180, the system 210 may be suitable for deployment on an unmanned vehicle such as the vehicle 70 of FIG. 4.

Figure 15:
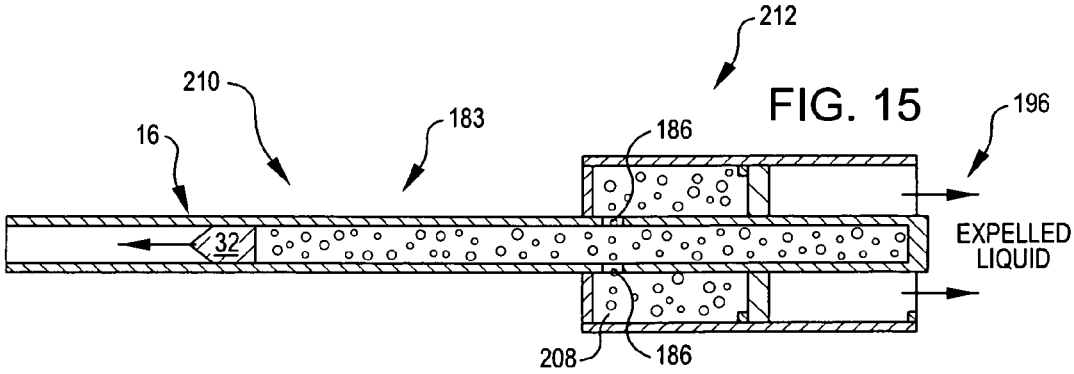
FIG. 15 is a cross-sectional view of the unguided-projectile system of FIG. 14 shortly after firing according to an embodiment of the invention.

FIG. 15 is a cross-sectional view of the embodiment of the unguided-projectile system 210 of FIG. 14 shortly after the detonation of the charge 28.

Referring to FIGS. 14-15, the operation of the system 210 according to an embodiment of the invention is similar to the above-described operation of the system 180, except that the expanding gas 208 acts directly on the liquid in the outer barrel 188 to force this liquid out of the open end 196 of the outer barrel. The momentum of this exiting liquid partially or fully cancels the momentum of the projectile 32 to partially or fully absorb the firing recoil.

FIG. 16 is a cross-sectional view of an unguided-projectile system 220 according to another embodiment of the invention, where like numbers refer to components common to FIGS. 1-3, 6, and 13-15, and where the detonator 14 (FIGS. 1 and 3) has been omitted for clarity. The system 220 may be similar in structure and operation to the unguided-projectile systems 10 and 60 of FIGS. 1 and 3, except that a recoil-absorbing mechanism 222 replaces the recoil-absorbing projectiles 34. Furthermore, the system 220 may be similar to the systems 180 and 210 of FIGS. 12-15 except that the recoil-absorbing mechanism 222 is different from the recoil-absorbing mechanism 182 and 212. Like the systems 10, 60, 180 (FIGS. 12-13), and 210 (FIGS. 14-15) the system 220 may be suitable for an unmanned vehicle, such as the unmanned vehicle 70 of FIG. 4, because the system is relatively small, substantially recoilless, and relatively inexpensive to maintain, and may be suitable for use underwater and in other liquid environments. Moreover, the system 220 fires unguided supercavitating projectiles 32 that have a range substantially greater than conventional unguided projectiles. The system 220 may also include a conventional targeting subsystem (not shown in FIG. 16) for aiming the inner barrel 16 of the gun 183. Examples of such a targeting subsystem include the targeting subsystems incorporated by unguided-projectile systems manufactured by Metal Storm Ltd. of Brisbane Australia.

The gun 183 of the system 220 includes the inner barrel 16, which is shown in cross section and which includes the chamber 18 having the wall 20, the open end 22, and the closed end 184. Inside the chamber 18 of the barrel 16 are disposed one or more charges 28 and a corresponding number of target-striking supercavitating projectiles 32. For clarity, only one charge 28 and one projectile 32 are shown. Where multiple charges 28 and projectiles 32 are disposed within the barrel 16, they may be "stacked" like the charges 28*a*-28*e* and the projectiles 32*a*-32*e* in the gun 140 of FIG. 6.

The system 220 also includes the recoil-absorbing mechanism 222, which includes an outer barrel 224, a piston 226, and the return spring 192.

The outer barrel 224 has open first and second ends 228 and 230, the piston stop 198, which is optional in this embodiment, and the spring stop 200. Although not shown in FIG. 16, one may attach the gun 183 to a vehicle or other apparatus by attaching the outer barrel 224 to the vehicle or apparatus.

The piston 226 has an inner edge that is attached to (e.g., welded, formed integral with) the outside of the inner barrel 16, and has an outer edge that forms a fluid-tight seal with the inner wall of the outer barrel 224. The fluid-tight seal allows the piston 226 to slide back and forth within the barrel 224.

The return spring 192, which is disposed between the piston stop 198 and the spring stop 200, urges the piston 226 against the piston stop. Where the piston stop 198 is not present, the spring 192 extends to its natural (i.e., its uncompressed and unstretched) length.

FIG. 17 is a cross-sectional view of the embodiment of the unguided-projectile system 220 of FIG. 16 shortly after the detonation of the charge 28.

Referring to FIGS. 16-17, the operation of the recoil-absorbing mechanism 222 is discussed according to an embodiment of the invention where the gun 183 is disposed and fired in a liquid environment such as underwater.

The detonation of the charge 28 generates the hot gas 208, which expands within the chamber 18 of the inner barrel 16 to propel the projectile 32 out of the barrel.

As the projectile 32 moves down the barrel 16, the expanding gas 208 also generates a force against the closed end 184 of the barrel 16, thus propelling the barrel in the opposite direction relative to the projectile 32.

Because the inner barrel 16 is attached to the piston 226, the piston moves with the inner barrel.

As the piston 226 moves, it forces liquid out of the open end 230 of the outer barrel 224.

In a manner similar to that discussed above in conjunction with FIGS. 1-3 and 12-15, the momentum (the product of the velocity and effective mass) of the liquid exiting the outer barrel 224 counteracts some or all of the momentum of the projectile 32, and thus absorbs some or all of the recoil resulting from the firing of the projectile. Knowing the properties of the charge 28, the projectile 32, and the liquid, one can use known mathematical relationships to calculate, e.g., the volume of the outer barrel 224 that provides a desired level of recoil absorption.

After the projectile 32 exits the inner barrel 16, the force generated on the closed end 184 by the gas 208 quickly dissipates, and, in response, the spring 192 urges the piston 226 back toward its at-rest position, which is against the piston stop 198 when the piston stop is present. As discussed above in conjunction with FIGS. 12-13 for the system 180, there may be a trade off between the rate at which one can fire the gun 183 and the maximum amount of recoil that the mechanism 212 can absorb.

Next, additional projectiles 32 (not shown in FIGS. 16-17) may be fired either before or after the spring urges the piston 226 back into its rest position. But firing a projectile 32 before the piston 226 is back in its rest position may reduce the amount of recoil that the mechanism 222 absorbs as compared to the amount of recoil absorbed when the piston is in its rest position when the projectile is fired.

Referring to FIGS. 12-17, other embodiments of the unguided-projectile systems 180, 210, and 220 are contemplated. For example, instead of preloading multiple charges 28 and projectiles 32 into the barrel 16, one or more of the systems 180, 210, and 220 may include a respective automatic-reload mechanism (not shown in FIGS. 12-17). Such a mechanism may include a hopper for holding one or more shells, where each shell includes a casing within which are disposed a charge 28 and projectile 32. In one embodiment, the reload mechanism derives operating energy from a portion of the recoil imparted to the gun 183 during the firing of a projectile 32. That is, the reload mechanism effectively absorbs a portion of the recoil, and converts this absorbed portion into mechanical motion that expels the spent shell from the barrel 16, and that loads a new shell from the hopper into the barrel 16. In another embodiment, the reload mechanism derives operating energy directly from the expanding gas 208 via a port such as the exhaust port 186. In yet another embodiment, the reload mechanism derives operating energy from a source that is independent of the energy generated by the firing of the gun 183. For example, the reload mechanism may be pneumatically driven by air pressure generated on board the vessel (not shown in FIGS. 12-17) to which the unguided-projectile system 180, 210, or 220 is attached or otherwise connected. Because the principles of such reload mechanisms are known, a more detailed discussion of these mechanisms is omitted for brevity. In addition, the inner barrels 16 and the outer barrels 188 and 224 may be other than cylindrical. Furthermore, alternate embodiments similar to those described above for the unguided-projectile system 10 of FIGS. 1-3 and for the gun 140 of FIG. 6 are also contemplated.

FIG. 18 is a view of an unmanned underwater vehicle 240 according to an embodiment of the invention, where like numbers reference components common to the unmanned underwater vehicle 70 of FIG. 4. The vehicle 240 may be similar to the vehicle 70, except that the vehicle 240 lacks a motorized propulsion unit and includes multiple unguided-projectile systems 242 (only systems 242*a*-242*e* shown in FIG. 18) that are aimed in different directions. Because the vehicle 240 includes unguided-projectile systems 242, the vehicle can often seek, acquire, and disable or destroy a target without destroying itself or the unguided-projectile systems. Consequently, the unguided-projection systems 242 may render the non-motorized vehicle 240 suitable for use as a "smart" mine that has a greater target-disabling/destroying ability than a conventional mine, and, that over time, is less costly than the number of conventional mines needed to disable or destroy a given number of targets.

Like the vehicle 70 of FIG. 4, the vehicle 240 is shaped like a torpedo, and, in addition to the unguided-projectile systems 242, includes the computing machine 74, hull 76, rudder 80, and sonar array 84 mounted to the nose 86. And although omitted from FIG. 18, the vehicle 240 may also include a steering mechanism for moving the rudder 80, a buoyancy system for setting the vehicle's depth, a guidance system that is self contained and/or communicates with a remote command center such as on board the ship that launched the vehicle, a power-supply system, or other conventional components and systems. The computing machine 74 may partially or fully control some or all of the above-described components and systems.

Each of the unguided-projectile systems 242 may be mounted to the outside of the hull 76 of the vehicle 240, and may be similar to or the same as one of the unguided-projectile systems 10, 180, 210, and 220 of FIGS. 1, 3, and 12-17. Furthermore, each of the systems 242 may be mounted to the hull 76 in a fixed orientation, or may be mounted with mechanical arms (not shown in FIG. 18) or with another mechanism that can move the respective gun 244 of the system relative to the hull. For example, the guns 244*a* and 244*d* of the systems 242*a* and 242*d* (the system 242*d* is only partially visible in FIG. 18) may be fixedly aimed upward, the gun 244*b* of the system 242*b* (and a corresponding gun of a system 242 on the other side of the vehicle 240 and not shown in FIG. 18) may be fixedly aimed straight ahead, and the guns 244*c* and 244*e* of the systems 242*c* and 242*e* (the system 242*e* is only partially visible in FIG. 18) may be fixedly aimed downward so that the vehicle 240 can disable or destroy a target at virtually any depth within the water (or within a predetermined altitude outside of the water if the vehicle is deployed at or near the surface).

The vehicle 240 may also include a sail 246 or other non-motorized propulsion unit. The sail 246 may have any suitable dimensions and construction and may be formed from any suitable material. Furthermore, the vehicle 240 may include a mechanism (not shown in FIG. 18) for retracting the sail 246 into a sail receptacle (not shown in FIG. 18) in the hull 76, and for extending the sail out from the receptacle. Moreover, the vehicle 240 may include a mechanism such as a motor (not shown in FIG. 18) for rotating or otherwise orienting the sail 246. The peer-vector machine 74 may control the retraction/extension mechanism and the sail orienting mechanism.

In one mode of operation, one deploys the vehicle 240 as a "smart" mine to destroy targets (not shown in FIG. 18) that enter an area "patrolled" by the vehicle. In this example, it is assumed that the targets are in the water, although the vehicle 240 may operate similarly for out-of-water targets when the vehicle is deployed at the surface of the water.

Once deployed, the peer vector machine 74 seeks out targets by causing the sonar array 84 to generate sonar signals and then analyzing return sonar signals, If the peer vector machine 74 detects a target, then it maneuvers the vehicle 240 into firing range and aims one or more of the guns 244 at the target by appropriately controlling the rudder 80 and sail 246—where the guns are moveable relative to the hull 76, then the peer vector machine may also aim the guns via the respective gun-aiming mechanisms (not shown in FIG. 18).

After the vehicle 240 is in firing range and the guns 244 are aimed, the peer vector machine 74 fires the guns to destroy the target. For example, the peer vector machine 74 may fire a spread of projectiles (not shown in FIG. 18) to increase the probability of destroying the target in a manner similar to that discussed above in conjunction with FIGS. 7-11. The peer vector machine 74 may also re-aim the gun(s) 244 between the firing of each set of projectiles that compose the spread.

Next, the peer vector machine 74 determines whether the target is destroyed via the sonar array 84.

If the target is not destroyed, the peer vector machine 74 may repeat the above-described procedure until the target is destroyed.

If the target is destroyed, the peer vector machine 74 resumes searching for other targets, and may maneuver the vehicle 240 back to its position before the above-described mission, or may maneuver the vehicle to another predetermined position.

Still referring to FIG. 18, alternate embodiments of the vehicle 240 are contemplated. For example, one can apply to the vehicle 240 some or all of the alternate embodiments described above for the vehicle 70 of FIG. 4. Furthermore, the vehicle 240 may use a technique other than sonar to detect and range targets. For example, the vehicle 240 may include a phased radar array or use LADAR to detect and range airborne or other out-of-water targets.

Figure 19:
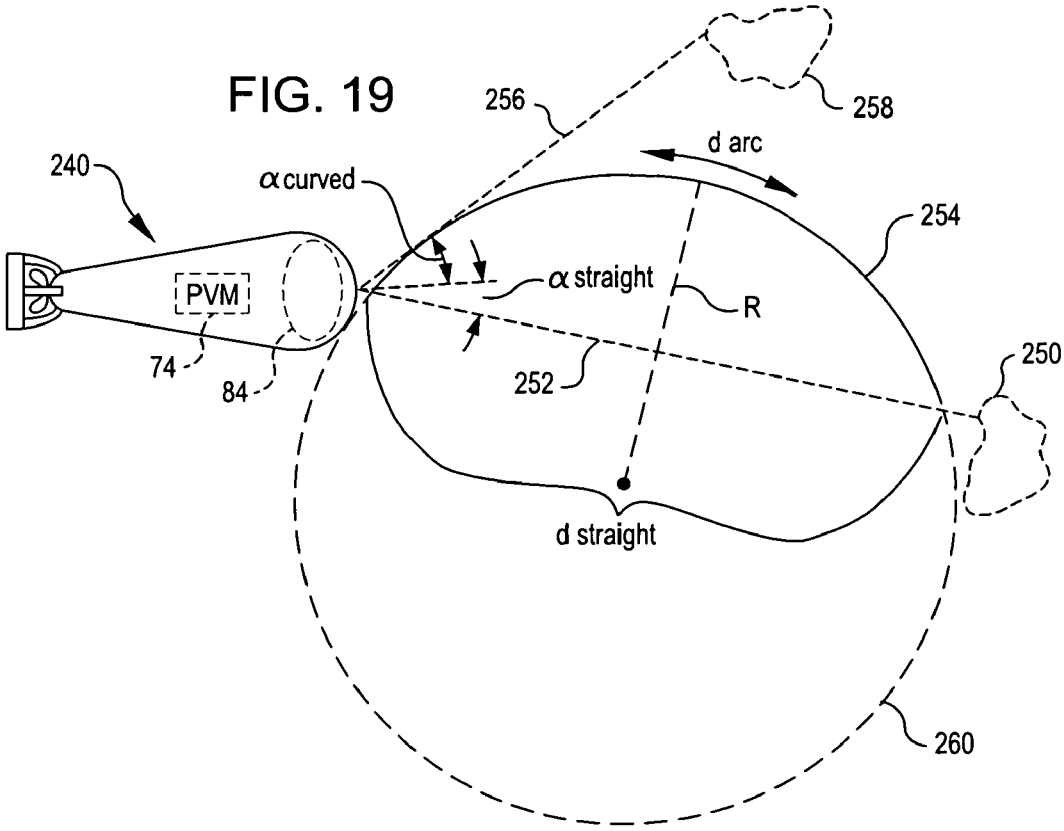
FIG. 19 is a diagram of a target-ranging technique that the vehicles of FIGS. 4 and 18 may perform according to an embodiment of the invention.

FIG. 19 illustrates a target-ranging technique that the vehicle 70 of FIG. 4 and the vehicle 240 of FIG. 18 may use according to an embodiment of the invention. For clarity, however, the ranging technique is described in conjunction with the vehicle 240, it being understood that the technique is similar when the vehicle 70 uses it.

Liquid environments, such as underwater environments, may "bend" sonar and other targeting signals, and this bending may introduce errors in a target-ranging calculation. Because the level of bending may depend on environmental properties, such as the mineral content and temperature of the water, the level of bending may fluctuate over time and with location.

For example, assume that the sonar array 84 (or another sonar source) emits a spread of sonar signals, some of which are incident on a test target 250 having a known location. In this example, for clarity of explanation, it is assumed that the signals are effectively incident on the target 250 along a straight path 252.

The target 250 reflects at least a portion of these incident sonar signals to the sonar array 84. But instead of the reflected sonar signals propagating along the straight path 252, the bending imparted by the water causes the reflected sonar signals to propagate along a curved path 254.

A conventional ranging algorithm, however, may assume that the sonar signals reflected from the target 250 and received by the array 84 propagated along a straight path 256, which is incident to the array 84 at a same angle of incidence $\alpha_{curved}$ as the curved path 254. Consequently, such a conventional ranging algorithm may incorrectly determine that the target 250 is in a location 258.

But the peer vector machine 74 (or other computing machine) may calculate a correction factor based on the known location of the test target 250 and the angle $\alpha_{curved}$ at which the curved path 254 is incident to the array 84. The peer vector machine 74 may then apply this correction factor to more accurately range targets.

In one example, the peer vector machine 74 first calculates the difference between the angles of incidence $\alpha_{curved}$ and $\alpha_{straight}$ of the curved path 254 and the known straight path 252 between the sonar array 84 and the test target 250; presumably, the sonar signals reflected from the test target would have propagated to the sonar array a length $d_{straight}$ along the straight path 252 but for the bending imparted to the reflected signals by the water.

Then, the peer vector machine 74 divides this angular difference $\alpha_{curved}-\alpha_{straight}$ by the length $d_{arc}$ along the curved path 254 to obtain a correction factor having units of angular shift over actual distance propagated. Typically, the length $d_{arc}$ can be determined by measuring the time between the emission of the sonar signals toward the target 250 and the receiving of the sonar signals reflected from the target—the propagation speed of the sonar signals through the water can be obtained from a table or can be determined by a separate test.

Next, assuming that the curved path 254 composes a portion of an imaginary circle 260, the peer vector machine 74 uses known geometrical relationships to determine from the length $d_{arc}$ and the length $d_{straight}$ the radius R of curvature of the curved path. It is assumed that at least on a first order, the radius R is common to all curved paths between a target and the sonar array 84. That is, it is assumed that the water bends all sonar signals in the same manner.

Then, the peer vector machine 74 uses the calculated correction factor and radius R to more accurately range a target (not shown in FIG. 19) having an unknown location. As an example, assume that the location of the target 250 is unknown. The peer vector machine 74 calculates the length $d_{arc}$ and the angle of incidence $\alpha_{curved}$ of the path 254, multiplies $d_{arc}$ the correction factor to obtain a correction value, and sums the correction value and $\alpha_{curved}$ to obtain the corrected angle of incidence $\alpha_{straight}$ of the straight path 252. Furthermore, using the known radius R of the curved path 254, the peer vector machine 74 calculates the length $d_{straight}$ of the straight path 252.

The peer vector machine 74 may employ a number of other known techniques for calculating the location of the target 250. For example, the sonar array 84 may be displaced angularly and/or the vehicle 240 may pitch and yaw. Consequently, an angle of incidence ($\alpha_{curved}$) of a reflected sonar signal from the target 250 may differ depending upon movement of the sonar array 84 and/or the vehicle 240 relative to the target 250. According to one embodiment of the invention, the peer vector machine 74 may calculate respective curved paths of reflected sonar signals from the target 250 associated with different positions of the sonar array 84 and/or the vehicle 240 relative to the target 250 employing a comprehensive acoustic simulation (CASS) that uses a Gaussian ray bundle (GRAB) model. The calculated paths are evaluated for points of convergence that are used by a probabilistic algorithm to determine the location of the target 250 and a corresponding range of error for the location of the target 250. The peer vector machine 74 may repeat this calculation process many times per second and a tracking algorithm (e.g., a Kalman Filter) may be used to obtain further error reduction.

The peer vector machine 74 or other computing machine may calculate an accurate location of the target 250 at a given time, using the vertical arrival angles and arrival bearings of the reflected sonar signals received by the sonar array 84. The vertical arrival angles of the reflected sonar signals are most susceptible to being affected by the speed of sound in the water. Given information about the speed of sound at different depths in the local water, the path traversed by the sound may be calculated by the peer vector machine 74 from the vertical arrival angle (i.e., $\alpha_{curved}$) using one of many different well-known mathematical approaches. The peer vector machine 74 computes the propagation path for each beam of sound received, tracing backwards from the sonar array 84. The peer vector machine 74 then analyzes the traces pair-by-pair, locating where propagation paths intersect or converge within some limited distance. There will be one suspected location for each pair of received propagation paths. Then, the peer vector machine 74 computes the optimal target location from the many suspected locations using one of many different well-known mathematical optimization techniques. As shown in the table below, the number of suspected locations increases geometrically with the number of received paths.

| Received paths | Number of Path Pairs | Number of Possible Locations | Set of Unique Pairs |
|---|---|---|---|
| 1 | None | No Solution | |
| 2 | 1 | 1 | {(1, 2)} |
| 3 | 3 | 3 | {(1, 2), (2, 3), (3, 1)} |
| 4 | 6 | 6 | {(1, 2), (1, 3), (1, 4), (2, 3), (2, 4), (3, 4)} |
| 5 | Σ(1, 2, 3, 4) | 10 | {(1, 2), (1, 3), (1, 4), (1, 5) (2, 3), (2, 4), (2, 5), (3, 4), (3, 5), (4, 5)} |
| n | Σ(1, 2, . . . , n − 1) | Σ(1, 2, . . . , n − 1) | {(1, 2), (1, 3), . . . (1, n) (2, 3), . . . (2, n), (3, 4), . . . (3, n), . . . (n − 1, n)} |

By using the speed of sound along each path, the travel time for each path is computed by the peer vector machine 74. The travel time is subtracted from the time when the reflected sonar signal was received. For n received propagation paths, there will be n estimates for the time when the sound was reflected or transmitted at the target. The peer vector machine 74 then reduces the optimal target reflection or transmission time using one of many different well-known mathematical optimization approaches. Thus, the target 250 may be localized in position and time using one of many different well-known mathematical approaches using the received sonar signals, the vehicle's 240 navigation position and time, and the sound velocity profile through the water.

The peer vector machine 74 then updates a track history of the target 250 with the computed localized position and time. Numerous mathematical approaches are well known to perform a prediction of a set of future locations of the target 250 from a track history. Normally, this computation also includes values for uncertainty. This set of predicted target locations and uncertainties is used to compute possible future projectile trajectories from the vehicle's 240 own navigation solutions using one of many different well-known mathematical techniques.

The peer vector machine 74 selects a future time and location of the target 250. As the sonar process and location prediction process iterate, the value of the location at a future time will normally converge or diverge. The converging future-time locations of the target 250 may be selected preferentially as aiming points that in turn are used to compute the vehicle's 240 maneuvers to aim the projectiles. Some of the aiming points may be eliminated because the needed maneuvers by the vehicle 240 may not be feasible. The peer vector machine 74 calculates the feasibility of the maneuver sets for the aiming points using the vehicle's 240 current navigation information and eliminates any unreasonable aiming points.

Then, peer vector machine 74 calculates the precise trigger time at which the vehicle 240 should fire the projectile by computing a trace of the vehicle's 240 future locations and calculating the projectile trajectory to the aiming points. The peer vector machine 74 slightly adjusts the maneuvers and trigger time, iteratively recalculating the projectile trajectory to the aiming points; until the projectile trajectory and the aiming point converge within some limit.

Of all the possible maneuver sets, one set is selected for execution based on the maneuver feasibility assessment, the trigger time, and the certainty of intercept. For example, the maneuver feasibility assessment, trigger time, and certainty of intercept may each be given a weighting factor.

In some embodiments of the invention, a ship (not shown) controls the vehicle 240 and may also be executing the target seeking sonar and tracking algorithms discussed above using its own sonar arrays. This second set of target location estimates may improve the location accuracy when combined with the vehicle's 240 target location estimates.

Still referring to FIG. 19 alternate embodiments of the above-described technique are contemplated. For example, although described for use with underwater sonar, this technique may be modified for use in other environments (e.g., air) with other range-finding systems such as radar. Furthermore, although the sonar signals incident on the target 250 are described as effectively being incident along the straight path 252, the peer vector machine 74 may use the above-described concepts to account for bending of the reflected sonar signals where the incident sonar signals are incident on the target 250 from a path other than the straight path 252. In addition, the peer vector machine 74 may use the above-described concepts to account for bending of the incident sonar signals between the emission source (e.g., the sonar array 84) and the target. Moreover, the peer vector machine 74 may periodically recalibrate the correction factor and the radius R so as to track these values with changing conditions or movement of the vehicle 240. Furthermore, although described in conjunction with an unmanned vehicle 240, a computing machine on any vessel may implement the above-described technique or otherwise make use of the above-described concepts.

Figure 20:
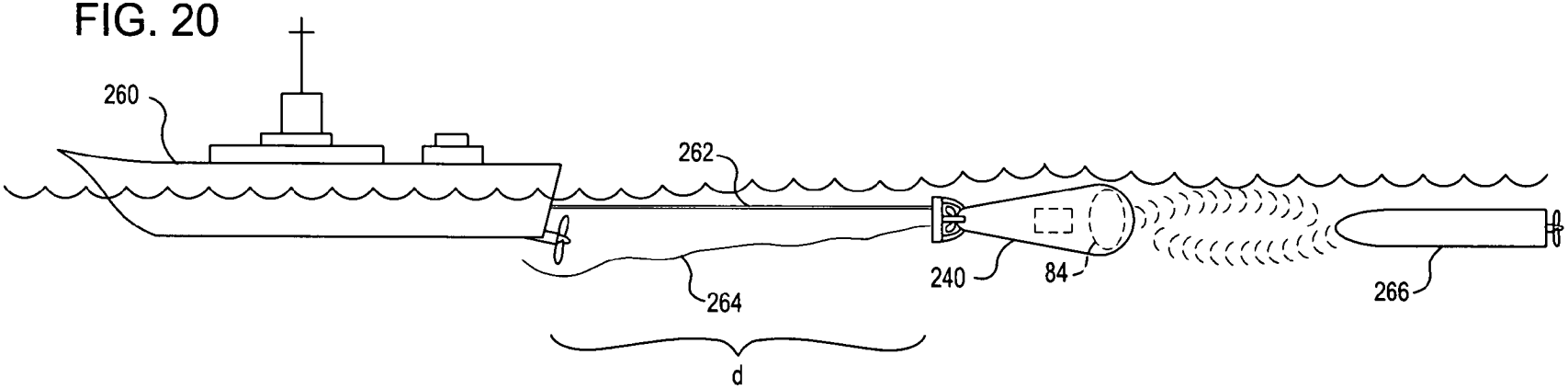
FIG. 20 is a view of a ship towing an unmanned vehicle such as the vehicle of FIG. 4 or the vehicle of FIG. 18 according to an embodiment of the invention.

FIG. 20 is a view of a ship 260 towing an unmanned vehicle, such as the vehicle 70 of FIG. 4 or the vehicle 240 of FIG. 18, according to an embodiment of the invention. For clarity, however, the ship 260 is shown towing the vehicle 240 with a tether 262, which may include, e.g., electrical conductors or optical fibers.

An enemy ship (not shown in FIG. 20) may target a "friendly" ship, such as the ship 260, from the rear, because the wake 264 formed by the friendly ship may reduce range within which the friendly ship can detect a rear-approaching weapon such as a torpedo 266. The noise from the wake 264 may mask the noise from the torpedo 266, thus reducing the range from which the sonar system (not shown in FIG. 20) of the ship 260 can "hear" the torpedo. Therefore, even if the ship 260 does eventually detect the torpedo 266, the time from detection to impact may not be long enough to allow the ship to take effective evasive action or to launch effective countermeasures.

But towing the vehicle 240 may increase the effective rearward weapons-detection range of the ship 260. Furthermore, where the vehicle 240 includes a weapon such as an unguided-projectile system 180 (FIG. 12), the vehicle may destroy a weapon such as the torpedo 266 at a range sufficient to prevent damage to the ship 260 from, e.g., the exploding torpedo.

In operation according to an embodiment of the invention, the ship 260 tows the vehicle 240 such that the vehicle's sonar array 84 is facing away from the ship, and at a distance d predetermined to provide the ship with a sufficient rearward weapons-detection range.

While the ship 260 is towing the vehicle 240, the peer vector machine 74 of the vehicle operates in a target-detection mode.

If the peer vector machine 74 detects a weapon such as the torpedo 266, it then aims and fires the weapons system(s) (e.g., system 180 of FIG. 12) of the vehicle 240 to destroy the torpedo at a distance from the ship 260 that is sufficient to prevent damage (e.g., from the exploding torpedo) to the ship and to the vehicle.

Alternatively, the peer vector machine 74 may notify the ship 260 that it has detected the torpedo 266, and the ship may take evasive action, launch countermeasures (not shown in FIG. 20), aim and fire an onboard weapon (not shown in FIG. 20), or cause the peer vector machine to aim and fire the weapons system(s) of the vehicle 240. Or, the peer vector machine 74 may launch countermeasures that are on board the vehicle 240.

Still referring to FIG. 20, alternate embodiments of the above-described towing technique are contemplated. For example, when the peer vector machine 74 detects a weapon such as the torpedo 266, the ship 260 may release the vehicle 240 from the tether 262 (or the vehicle may release itself) to allow the vehicle greater maneuvering ability=replacing the vehicle 240 with a vehicle, such as the vehicle 70 (FIG. 4) having a motorized propulsion unit may provide even more maneuverability, and may facilitate a rendezvous between the ship 260 and the vehicle after the weapon is disabled or destroyed. Or, the vehicle 240 may simply act as a decoy that the torpedo 266 targets and destroys at a distance sufficient to prevent damage to the ship 260. Furthermore, where the vehicle 240 acts as a decoy or the ship 260 destroys the torpedo after its detection, then the vehicle may lack a weapons system. In addition, although the ship 260 is shown towing only one vehicle 240, it may tow multiple vehicles.

FIG. 21 is a view of a "friendly" submarine 270 and an unmanned vehicle, such as the vehicle 70 of FIG. 4 or the vehicle 240 of FIG. 8, cooperating to seek and destroy a target 272 (here an enemy submarine) according to an embodiment of the invention. For clarity, an unmanned vehicle **240*a* is shown, it being understood that the following discussion is also applicable for a vehicle 70. As discussed below, cooperating with the unmanned vehicle 240*a* provides the friendly submarine 270** with a greater degree of stealth and may also provide other advantages.

The friendly submarine 270 includes a sonar array 274 and a computer system 276, and the vehicle 240 includes the peer vector machine 74 and the sonar array 84. The computer system 276 may also be a peer vector machine. An optional line 278 may tether the vehicle **240*a* to the friendly submarine 270**, and may include a communications link (e.g., electrical or optical) over which the friendly submarine and vehicle may communicate.

Still referring to FIG. 21, the cooperation between the friendly submarine 270 and the vehicle **240*a*** is described according to an embodiment of the invention.

The friendly submarine 270 launches the vehicle **240*a*, for example from a torpedo tube (not shown in FIG. 21**), when it is searching for an enemy vessel or weapon, or when it otherwise suspects that an enemy vessel or weapon is in the area.

Next, the vehicle **240*a* moves a predetermined distance away from the friendly submarine 270. Alternatively, the friendly submarine 270 may move the predetermined distance away from the vehicle 240*a*, particularly if the vehicle 240*a* is deployed under water (the vehicle 240*a* may not include a motorized propulsion unit). Or, the friendly submarine 270 and the vehicle 240*a*** may both move away from each other until a predetermined distance separates them.

Then, under the control of the peer vector machine 74, the sonar array 84 on the vehicle **240*a* emits sonar signals, but the sonar array 274 of the friendly submarine 270 emits no sonar signals. Because the sonar array 274 emits no sonar signals, the enemy submarine 272 cannot detect the position of the friendly submarine 270 by ranging the source of the emitted sonar signals. This may delay or prevent the detection of the friendly submarine 272 by the enemy submarine 270. And even if the delay is relatively short, it may be long enough to give the friendly submarine 270 an advantage over the enemy submarine 272. Furthermore, although the enemy submarine 272 may determine the location of the vehicle 240***a* from the emitted sonar signals, the vehicle is typically considered expendable relative to the friendly submarine 270. In addition, if the enemy submarine 272 fires on the vehicle 240*a*, this may "give away" the location of the enemy submarine to the friendly submarine 270, thus facilitating the friendly submarine's disabling or destroying of the enemy submarine.

Next, the sonar array 84 receives sonar signals reflected from the enemy submarine 272, and the peer vector machine 74 determines the location of the enemy submarine from the reflected sonar signals and provides the location to the friendly submarine 270.

According to an alternative, the sonar array 274 on the friendly submarine 270 receives the signals reflected from the enemy submarine 272, and the computer system 276 on board the friendly submarine determines the location of the enemy submarine from the reflected sonar signals.

According to another alternative, both the sonar arrays 84 and 274 receive sonar signals reflected from the enemy submarine 272, and the peer vector machine 74 and the computer system 276 cooperate to triangulate the location of the enemy submarine. The computer system 276 may provide the raw sonar data received by the sonar array 274 to the peer vector machine 74, which triangulates the location of the enemy submarine 272 from this data and the sonar data received by the sonar array 84. Or, the peer vector machine 74 may provide the raw sonar data received by the sonar array 84 to the computer system 276, which triangulates the location of the enemy submarine 272 from this data and the sonar data received by the sonar array 274. Alternatively, the peer vector machine 74 and computing system 276 may cooperate in any other manner to triangulate the location of the enemy submarine 272. Triangulating the location of the enemy submarine 272 from reflected sonar signals received at both of the arrays 84 and 274 may be more accurate than determining the location of the enemy submarine from reflected sonar signals received at only one of the sonar arrays.

After the friendly submarine 270 and/or the vehicle 240*a* locate the enemy submarine 272, the friendly submarine may launch an attack against the enemy submarine.

For example, if the vehicle 240*a* includes a weapon (not shown in FIG. 21), then the computer system 276 may command the vehicle to aim and fire the weapon at the enemy submarine 272.

Alternatively, the friendly submarine 270 may command another vehicle 240*b* to aim and fire a weapon (not shown in FIG. 21) at the enemy submarine 272. The friendly submarine 270 may launch the vehicle 240*b* either before or after the enemy submarine 272 is located. If the friendly submarine 270 pre-launches the vehicle 240*b* before the enemy submarine 272 is located, then the vehicle 240*b* may deactivate its propulsion unit, or may maneuver relatively slowly, to avoid detection by the enemy submarine 272.

Or, the friendly submarine 270 may aim and fire a weapon such as a torpedo 276 at the enemy submarine 272. The friendly submarine 270 may fire the torpedo 276 at the enemy submarine 272 directly from a launch tube (not shown in FIG. 21). Alternatively, the friendly submarine 270 may pre-launch the torpedo 276 before the enemy submarine 272 is located, and then fire the torpedo from outside of the friendly submarine after the location of the enemy submarine is determined. If the friendly submarine 270 pre-launches the torpedo 276 before the enemy submarine 272 is located, then the torpedo may deactivate its propulsion unit, or may maneuver relatively slowly, to avoid detection by the enemy submarine 272.

Alternatively, the friendly submarine 270 may launch countermeasures (not shown in FIG. 21) against the enemy submarine 272, or may fire one or more weapons according to any combination of one or more of the firing procedures described above.

After the enemy submarine 272 is destroyed or otherwise neutralized, the friendly submarine 270 may recall the vehicle 240*a* and the vehicle 240*b* if present. The friendly submarine 270 may also recall the torpedo 276 if the torpedo was not fired. Alternatively, the friendly submarine 270 may recall only some, or may recall none, of the vehicles 240*a* and 240*b* and the torpedo 276.

Still referring to FIG. 21, alternate embodiments of the above-described techniques are contemplated. For example, although only a single sonar-emitting-and-receiving vehicle 240*a* is shown, the friendly submarine may utilize more than one such vehicle for redundancy or to more accurately determine the location of the enemy submarine 272. Furthermore, although a friendly submarine 270 is shown, the above-described techniques are applicable for a surface ship, and for a non-water ship and a non-water manned vehicle (e.g., airplane and unmanned air vehicle, space ship and unmanned space vehicle), respectively. In addition, the friendly submarine 270 may launch or pre-launch multiple vehicles 240*b* or multiple torpedoes 276.

FIG. 22 is a view of unmanned vehicles, such as the vehicles 70 and 240 of FIGS. 4 and 8, respectively, deployed to form a defensive perimeter 280 according to an embodiment of the invention. For clarity, only unmanned vehicles $\mathbf{240}_1$-$\mathbf{240}_n$ are shown composing the perimeter 280, it being understood that vehicles 70, or any combination of vehicles 70 and 240, may compose the perimeter. Furthermore, the perimeter 280 may be on the surface of the water or beneath the water.

A ship (not shown in FIG. 22) deploys the vehicles $\mathbf{240}_1$-$\mathbf{240}_n$ in the desired positions, or the vehicles maneuver to their desired positions after they are deployed.

Once in their desired positions, the vehicles $\mathbf{240}_1$-$\mathbf{240}_n$ may maneuver under control of the respective peer vector machines $\mathbf{74}_1$-$\mathbf{74}_n$ or under control of the shipboard computer system (not shown in FIG. 22) to maintain their respective positions along the perimeter 280 despite forces, e.g., water currents and wind, that may act to move the vehicles out of position. The vehicles $\mathbf{240}_1$-$\mathbf{240}_n$ may also maneuver in formation; that is, the vehicles may move but maintain the same positions relative to one another so as to move the perimeter 280.

If one of the vehicles $\mathbf{240}_1$-$\mathbf{240}_n$ detects a target (not shown in FIG. 22), then the detecting vehicle only may range the target and aim and fire a weapon at the target. Or, the detecting one of the vehicles $\mathbf{240}_1$-$\mathbf{240}_n$ may notify one or more other of the vehicles, the deploying ship, or another vessel (not shown in FIG. 22) to range the target and aim and fire a weapon at the target. In the latter circumstance, the detecting vehicle may or may not range the target and aim and fire a weapon at the target. The detecting one of the vehicles $\mathbf{240}_1$-$\mathbf{240}_n$, the one or more other vehicles, the deploying ship, or the other vessel may continue this procedure until the target is disabled or destroyed—either the deploying ship (not shown in FIG. 22), one or more of the vehicles, or other vessel (not shown in FIG. 22) may detect the disablement or destruction of the target.

If the vehicles $\mathbf{240}_1$-$\mathbf{240}_n$ do not have weapons, then the vehicle that detects the target (not shown in FIG. 22) may notify the deploying ship or another vessel (neither shown in FIG. 22), which then fires a weapon to disable or destroy the target.

Still referring to FIG. 22, alternate embodiments of the perimeter 280 are contemplated. For example, although shown as lying along an arc, the perimeter 280 may have any other suitable shape. Furthermore, multiple perimeters 280 may be "stacked" to form a deeper perimeter.

The preceding discussion is presented to enable a person skilled in the art to make and use the invention. Various modifications to the embodiments will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein.

What is claimed is:

1. A projectile accelerator, comprising:

a first enclosure having an open first end and a closed second end;

first and second charges disposed within the first enclosure;

a first projectile disposed within the first enclosure between the first charge and the first end and operable to exit the first enclosure via the first end and to generate a first recoil in response to detonation of the first charge;

a second projectile disposed within the first enclosure between the first charge and the second charge and operable to exit the first enclosure via the first end and to generate a second recoil in response to detonation of the second charge;

a mechanism disposed adjacent to the first enclosure and operable to absorb at least a respective portion of each of the first and second recoil;

wherein the first enclosure comprises an exhaust port disposed between the first and second ends and operable to discharge respective gases generated by the detonation of the first and second charges; and wherein the mechanism comprises, a second enclosure that surrounds the exhaust port of the first enclosure, includes a closed first end attached to the first enclosure between the first end and the exhaust port of the first enclosure, and includes an open second end, a piston that is disposed within the second enclosure between the exhaust port and the second end of the first enclosure and has an opening through which the first enclosure extends, and a piston-return spring that is disposed within the second enclosure between the piston and the second end of the second enclosure.

2. The projectile accelerator of claim 1 wherein:

the closed first end of the second enclosure substantially seals with the first enclosure; and the piston substantially seals with an outer surface of the first enclosure and with an inner surface of the second enclosure.

3. The projectile accelerator of claim 1 wherein the piston-return spring is operable to urge the piston toward the closed first end of the second enclosure.

4. The projectile accelerator of claim 1 wherein the first and second recoils are absorbed to an extent that are related to a stiffness of the piston-return spring.

5. The projectile accelerator of claim 1, further comprising a piston stop attached to an inner surface of the second enclosure and configured to restrict displacement of the piston in an axial direction.

6. A projectile accelerator, comprising:

a first enclosure having an open first end and a closed second end;

first and second charges disposed within the first enclosure;

a first projectile disposed within the first enclosure between the first charge and the first end and operable to exit the first enclosure via the first end and to generate a first recoil in response to detonation of the first charge;

a second projectile disposed within the first enclosure between the first charge and the second charge and operable to exit the first enclosure via the first end and to generate a second recoil in response to detonation of the second charge;

a mechanism disposed adjacent to the first enclosure and operable to absorb at least a respective portion of each of the first and second recoil;

wherein the first enclosure comprises an exhaust port disposed between the first and second ends and operable to discharge respective gases generated by the detonation of the first and second charges; and wherein the mechanism comprises, a second enclosure that surrounds the exhaust port of the first enclosure, includes a closed first end attached to the first enclosure between the first end and the exhaust port of the first enclosure, and includes an open second end, and a piston that is disposed within the second enclosure between the exhaust port and the second end of the first enclosure and has an opening through which the first enclosure extends.

7. A projectile accelerator, comprising:

a first enclosure having an open first end and a closed second end;

first and second charges disposed within the first enclosure;

a first projectile disposed within the first enclosure between the first charge and the first end and operable to exit the first enclosure via the first end and to generate a first recoil in response to detonation of the first charge;

a second projectile disposed within the first enclosure between the first charge and the second charge and operable to exit the first enclosure via the first end and to generate a second recoil in response to detonation of the second charge;

a mechanism disposed adjacent to the first enclosure and operable to absorb at least a respective portion of each of the first and second recoil;

wherein the mechanism comprises:

a second enclosure that is disposed around the first enclosure and includes open first and second ends;

a piston that is disposed within the second enclosure and around the first enclosure, and that is attached to the first enclosure; and a piston-return spring that is disposed within the second enclosure between the piston and the second end of the second enclosure.

8. The projectile accelerator of claim 7 wherein the piston is integrally formed with the first enclosure.

9. The projectile accelerator of claim 7 wherein:

the second enclosure comprises an inner surface; and the piston substantially seals with the inner surface of the second enclosure.

10. The projectile accelerator of claim 7 wherein the piston-return spring is operable to bias against the piston to displace the first enclosure relative to the second enclosure.

11. The projectile accelerator of claim 7 wherein the first and second recoils are absorbed to an extent that are related to a stiffness of the piston-return spring.

12. The projectile accelerator of claim 7 wherein the piston-return spring is operable to bias the piston toward the open first end of the second enclosure.

13. The projectile accelerator of claim 7, further comprising a piston stop attached to an outer surface of the first enclosure and configured to restrict displacement of the piston in an axial direction.

14. A projectile accelerator, comprising:

a first enclosure having an open first end, a closed second end, and an exhaust-gas-discharge port disposed between the first and second ends;

first and second charges disposed within the first enclosure;

a first projectile disposed within the first enclosure between the first charge and the first end and operable to exit the first enclosure via the first end and to generate a first recoil in response to detonation of the first charge;

a second projectile disposed within the first enclosure between the first charge and the second charge and operable to exit the first enclosure via the first end and to generate a second recoil in response to detonation of the second charge; and a second enclosure that surrounds the exhaust port of the first enclosure, includes a closed first end attached to the first enclosure between the first end and the exhaust port of the first enclosure, and includes an open second end.

15. A projectile accelerator, comprising:

a first enclosure having an open first end, a closed second end, and an exhaust-gas-discharge port disposed between the first and second ends;

first and second charges disposed within the first enclosure;

a first projectile disposed within the first enclosure between the first charge and the first end and operable to exit the first enclosure via the first end and to generate a first recoil in response to detonation of the first charge;

a second projectile disposed within the first enclosure between the first charge and the second charge and operable to exit the first enclosure via the first end and to generate a second recoil in response to detonation of the second charge;

a second enclosure that surrounds the exhaust port of the first enclosure, includes a closed first end attached to the first enclosure between the first end and the exhaust port of the first enclosure, and includes an open second end; and wherein the first enclosure extends through the first end of the second enclosure.

* * * * *